US011718931B2

(12) United States Patent
Schnabel et al.

(10) Patent No.: US 11,718,931 B2
(45) Date of Patent: Aug. 8, 2023

(54) WEAVING MACHINE, METHOD FOR SIMULTANEOUSLY WEAVING TWO PILE FABRICS ON SUCH A MACHINE AND PILE FABRIC OBTAINABLE WITH SUCH A METHOD

(71) Applicant: STAUBLI BAYREUTH GMBH, Bayreuth (DE)

(72) Inventors: Andreas Schnabel, Bindlach (DE); Martin Burkert, Bayreuth (DE); Karsten Siebert, Weidenberg (DE); Bert Pols, Pt Mijdrecht (NL)

(73) Assignee: STAUBLI BAYREUTH GMBH, Bayreuth (DE)

( * ) Notice: Subject to any disclaimer, the term of this patent is extended or adjusted under 35 U.S.C. 154(b) by 328 days.

(21) Appl. No.: 16/620,063

(22) PCT Filed: Jun. 15, 2017

(86) PCT No.: PCT/EP2017/064674
§ 371 (c)(1),
(2) Date: Dec. 6, 2019

(87) PCT Pub. No.: WO2018/228694
PCT Pub. Date: Dec. 20, 2018

(65) Prior Publication Data

US 2020/0123686 A1 Apr. 23, 2020

(51) Int. Cl.
*D03D 39/18* (2006.01)
*D02G 3/34* (2006.01)
(Continued)

(52) U.S. Cl.
CPC ..... *D03D 39/18* (2013.01); *D02G 3/346* (2013.01); *D03D 15/54* (2021.01); *D03D 27/10* (2013.01); *D06P 5/30* (2013.01)

(58) Field of Classification Search
None
See application file for complete search history.

(56) References Cited

U.S. PATENT DOCUMENTS 892,517 A 7/1908 Heald
4,210,078 A * 7/1980 Greiner ..... B41F 33/0036 101/136
(Continued)

FOREIGN PATENT DOCUMENTS

CN 208884170 U * 5/2019
CN 210975180 U * 7/2020
(Continued)

OTHER PUBLICATIONS

"Static Beat: S-Wrap Rollers." Paper, Film & Foil Converter, Jul. 13, 2012, https://www.pffc-online.com/surface-prep/10423-static-beat-s-wrap-rollers. (Year: 2012).*
(Continued)

*Primary Examiner* — Khoa D Huynh
*Assistant Examiner* — Grace Huang

(57) ABSTRACT

This weaving machine (2) is for simultaneously weaving top and bottom pile fabrics (F2, F4) presenting some pile patterns (P2, P2', P4) and including tufts, made from warp yarns (24), binding warp yarns (14, 16) and inwoven weft yarns. This machine includes a pile warp yarns feeding unit (20), a binding warp yarns feeding unit (18), a shedding unit (6) and a weft insertion unit (8) for inserting the weft yarns in the shed. The machine also includes a beating-up mechanism (32), a take up system (70), a drawing-in unit (26), and a control unit (80). A treatment unit (90) is located, along a path of the pile warp yarns (24), between the pile warp yarns feeding unit (20) and the shedding unit (6), for applying different segments of treatment on at least some of the pile warp yarns (24).

20 Claims, 13 Drawing Sheets

(51) Int. Cl.

| | |
|---|---|
| ***D03D 27/10*** | (2006.01) |
| ***D06P 5/30*** | (2006.01) |
| ***D03D 15/54*** | (2021.01) |

(56) References Cited

U.S. PATENT DOCUMENTS 4,259,994 A * 4/1981 Hobson ..... D03D 25/00 139/1 R
4,324,490 A * 4/1982 Burnham ..... G03G 15/0928 399/276
4,452,160 A * 6/1984 Tajiri ..... D02G 1/0266 112/410
5,042,405 A * 8/1991 Bradley ..... D05C 15/18 112/80.7
5,076,809 A * 12/1991 Bouglas ..... D06B 3/04 8/478
5,148,746 A * 9/1992 Fuller ..... B08B 1/04 101/142
5,226,227 A * 7/1993 Yoshida ..... A44B 19/34 28/178
5,317,390 A * 5/1994 Bolza-Schunemann ..... G06T 7/001 356/394
5,398,730 A * 3/1995 Derudder ..... D03D 27/10 139/21
5,566,629 A * 10/1996 Satterfield ..... D05C 15/32 112/80.01
5,655,574 A * 8/1997 Warnecke ..... D03D 39/16 139/398
5,738,030 A * 4/1998 Ok ..... D05C 15/26 112/475.23
5,983,952 A * 11/1999 Carpenter ..... D03J 1/007 428/196
6,142,619 A * 11/2000 Miura ..... B41J 3/4078 347/101
6,243,110 B1 * 6/2001 Takahashi ..... D06P 5/30 347/5
6,328,078 B1 12/2001 Wildeman et al.
6,911,245 B2 * 6/2005 Beistline ..... A47G 27/0275 428/85
6,923,219 B2 * 8/2005 Shteiyer ..... D03D 27/10 139/394
6,974,785 B1 * 12/2005 Barbeau ..... D03D 15/513 428/920
7,033,661 B2 * 4/2006 Whitten ..... D05C 15/34 428/88
7,070,257 B2 * 7/2006 Silverbrook ..... B41J 2/155 347/42
7,070,846 B2 * 7/2006 Beistline ..... A47G 27/0275 428/88
7,111,647 B2 * 9/2006 Debaes ..... D03D 39/16 139/21
7,287,552 B2 * 10/2007 Debaes ..... D03D 27/10 139/191
7,426,895 B2 * 9/2008 Smith ..... D05C 15/26 112/80.32
7,823,522 B2 * 11/2010 Hardwig ..... D03D 15/54 112/439
8,122,915 B2 * 2/2012 Bloch ..... D03D 15/283 139/408
8,359,989 B2 * 1/2013 Hall ..... D05C 11/00 112/80.23
8,651,150 B2 * 2/2014 Siebert ..... D03D 39/18 139/21
9,027,366 B2 * 5/2015 Raynor ..... D04B 39/00 66/1 R
9,770,931 B2 * 9/2017 Zhou ..... D06M 13/285
10,059,093 B2 * 8/2018 Schaede ..... B41F 9/06
10,239,329 B2 * 3/2019 Niu ..... D06P 1/48
10,357,987 B2 * 7/2019 Zhou ..... B41M 5/5245
2002/0189702 A1 * 12/2002 Smissaert ..... D03D 27/10 139/418
2003/0064646 A1 * 4/2003 Brown ..... D04B 21/04 428/364
2003/0139840 A1 * 7/2003 Magee ..... D06B 11/0059 700/133
2004/0100512 A1 * 5/2004 Codos ..... B41J 3/4073 347/8
2006/0125898 A1 * 6/2006 Liang ..... B41J 3/60 347/104
2006/0180041 A1 8/2006 Kadota
2013/0226234 A1 * 8/2013 Avelar ..... D07B 5/005 606/228
2014/0212618 A1 * 7/2014 McBride ..... D06P 5/12 428/54
2015/0174638 A1 * 6/2015 Anguera ..... B65D 7/42 220/674
2016/0201234 A1 * 7/2016 Khokar ..... D03D 41/004 139/384 R
2018/0117901 A1 * 5/2018 Kamoda ..... B41J 2/01

FOREIGN PATENT DOCUMENTS

| | | | | |
|---|---|---|---|---|
| DE | 199372 | | 11/1906 | |
| DE | 199372 | C | 11/1906 | |
| EP | 1046734 | A2 | 10/2000 | |
| GB | 478423 | A * | 1/1938 | ..... B41L 21/02 |
| GB | 773816 | A * | 5/1957 | ..... D02G 1/02 |
| JP | 2008063680 | A | 3/2008 | |

OTHER PUBLICATIONS

ISR for WOPublication PCT/EP2017/064674, Dated Mar. 1, 2018,2 Pages.

* cited by examiner

WEAVING MACHINE, METHOD FOR SIMULTANEOUSLY WEAVING TWO PILE FABRICS ON SUCH A MACHINE AND PILE FABRIC OBTAINABLE WITH SUCH A METHOD

CROSS-REFERENCE TO RELATED APPLICATIONS

The present application is a National State entry, filed Dec. 6, 2019, of international application no. PCT/EP2017/064674, filed on Jun. 15, 2017.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO A SEQUENCE LISTING

Not applicable.

STATEMENT REGARDING PRIOR DISCLOSURES BY THE INVENTOR OR A JOINT INVENTOR

Not applicable.

BACKGROUND OF THE INVENTION

Field of the Invention

The present invention relates to a weaving machine for simultaneously weaving two pile fabrics presenting pile patterns, such as carpets or similar fabrics. The present invention also relates to a method for simultaneously weaving two such pile fabrics. Finally, the invention relates to a pile fabric presenting front patterns on its front side and back patterns on its back side, such pile fabric being obtainable via such a method implemented on such a weaving machine.

Brief Discussion of the Prior Art

In the field of carpet weaving, it is known from EP-A-1 046 734 to implement a process for producing double carpets with mixed contours. A computer-controlled Jacquard machine moves the pile yarns in order to weave them into a backing fabric, as required by a pattern. The figuring pile yarns alternate in the two fabrics for producing a top fabric and a bottom fabric at the same time. The pile yarns are interlaced between these two fabrics, so that a sandwich is created which is later cut to create two carpets with tufts. The non-figuring pile yarns are tied up, as buried or dead piles, in each fabric, between inner and back filling yarns. Patterning pile yarns alternate with non-patterning pile yarns, in order to obtain multi-coloured patterns in the top and bottom fabrics.

With such an approach each pile yarn is unwound from a corresponding bobbin which belongs to a creel, several hundreds to several thousands of bobbins being needed to realize a 2 meter wide carpet, which limits the pile density because of the high number of dead piles in the fabric.

Installment and setting of a weaving machine is very time consuming and its maintenance is difficult and expensive. Moreover, some pile yarns, like pile yarns made of polypropylene or polyester, might need to be prepared prior to be wound on bobbins which implies the use of extra bobbins. As a result, the weight of the fabric and the pile yarn consumption are very important, in particular because of the number of pre-dyed material needed and because a substantial portion of the warp yarn material is hidden in the backing fabric as dead piles. Moreover changing the configuration of the weaving machine for adapting the carpets to a new design is difficult, time consuming and limited to the colours of bobbins available in the creel.

On the other hand, U.S. Pat. No. 6,328,078 teaches the use of a digital device for printing some warp yarns which are later incorporated into a flat fabric during its formation. Warp yarns are printed with a printed pattern which exactly matches a woven pattern, in order to create an overall design with distinct lines. This technique is suitable for flat fabrics where warp yarns are woven with corresponding weft yarns, but it would not apply to pile fabrics.

The invention aims at providing a new weaving machine for simultaneously weaving two pile fabrics presenting pile patterns, this weaving machine being more versatile, easier and more economical to maintain and allowing manufacture of pile fabrics with high quality pile patterns.

SUMMARY OF THE INVENTION

To this end, the invention concerns a weaving machine for simultaneously weaving a top pile fabric and a bottom pile fabric, each pile fabric presenting one or several pile patterns and including piles, made from warp yarns, binding warp yarns and weft yarns, the machine comprising

- a pile warp yarns feeding unit,
- a binding warp yarns feeding unit,
- a shedding unit for creating a shed with the pile warp yarns and the binding warp yarns,
- a weft insertion unit for inserting the weft yarns in the shed in successive insertion cycles,
- a beating-up mechanism for beating the weft yarns into the shed,
- a take up system for taking-up the two pile fabrics and
- a control unit for controlling operation of the weaving machine.

According to the invention, the weaving machine also comprises a treatment unit located, along a path of the pile warp yarns, between the pile warp yarns feeding unit and the shedding unit, for applying different segments of treatment on at least some of the pile warp yarns.

According to further aspects of the invention, which are advantageous but not compulsory, such a machine might incorporate one or several of the following technical features taken in any admissible configuration:

- The treatment unit is configured for varying the segments of treatment along a direction parallel to a weft insertion axis.
- The treatment unit includes at least one printing head for a applying a colour treatment in the form of segments on the pile warp yarns.
- This weaving machine comprises a drawing-in unit for drawing the pile warp yarns from the pile warp yarn unit, whereas the drawing in unit provides a uniform tension and/or a uniform yarn feed rate of the pile warp yarns along a direction parallel to a weft insertion axis.
- The weaving machine further comprises a buffer mechanism located, along a path of the pile warp yarns, between the treatment unit and the shedding unit, for providing a constant warp yarns speed at the level of the treatment unit, while compensating the pile warp yarns speed fluctuations due to shedding and beating-up.

The weaving machine further comprises an adjusting sub-assembly for adjusting the position of the segments of treatment products in the fabrics.

The adjusting sub-assembly includes at least one sensor for determining the position and/or the length of the segments of treatment in the fabrics and/or in the warp sheet, and/or for identifying a trend of an offset of the segments in the fabrics.

The adjusting sub-assembly includes a set of rollers adapted to modify the tension and/or the feed rate of the warp sheet between the pile yarns feeding unit and the shedding unit or individual actuators adapted to modify the tension and/or the feed rate of individual pile warp yarn between the pile yarns feeding unit and the shedding unit.

The adjusting sub-assembly is configured for adjusting the position of some segments of treatment in the fabrics by shifting a printed pattern along a warp axis, in particular by moving the pile warp yarns with respect to the treatment unit.

The adjusting sub-assembly is configured for varying the position and/or the length of some segments of treatment on at least one pile warp yarn of the fabrics by changing the operation sequence of the treatment unit.

The machine comprises a cutting unit for cutting warp yarns into cut pile tufts to separate the top pile fabric and the bottom pile fabric.

In a second aspect, the invention concerns a method for simultaneously weaving a top pile fabric and a bottom pile fabric, each pile fabric presenting pile patterns and including tufts made from pile warp yarns, binding warp yarns and weft yarns. This method takes place on a face-to-face weaving machine which can be as mentioned here-above and comprises a pile warp yarn feeding unit, a binding warp yarns feeding unit, a shedding unit for creating a shed with the pile warp yarns and the binding warp yarns, a weft insertion unit for inserting the weft yarns in the shed in successive insertion cycles, a beating-up mechanism for beating-up the weft yarns into the shed, a take-up system for taking-up the two pile fabrics, a drawing-in unit for drawing the pile warp yarns from the pile warp yarn unit and a control unit for controlling the weaving machine. According to the invention, the method includes at least the following steps:

a) presenting the pile warp yarns to a treatment unit located, along a path of the pile warp yarns, between the pile warp yarns feeding unit and the shedding unit, b) applying, with the treatment unit, different segments of treatment on at least some of the pile warp yarns c) weaving the treated pile warp yarns into the two pile fabrics.

According to further aspects of the invention, which are advantageous but not compulsory, such a method might incorporate one or several of the following technical features, taken in any admissible combination:

Step b) includes a printing operation during which a printed yarn pattern is applied on the pile warp yarns, in the form of successive dyed segments, for forming a final pile pattern on each pile fabric.

The method includes a preliminary step consisting in aa) determining the printed yarn pattern from the final pile pattern of each woven fabric.

The printed pattern defined during preliminary step aa) includes first dyed segments dedicated to the pile pattern in the top pile fabric and second dyed segments dedicated to the pile pattern in the bottom pile fabric.

The printed pattern defined during preliminary step aa) includes third dyed segments dedicated to a back side pattern of the top pile fabric and fourth dyed segments dedicated to a back side pattern in the bottom pile fabric.

The method includes an adjusting step d) comprising at least the following elementary step d1) where a picture of at least one pile fabric and/or a picture of the warp sheet is taken and this picture is transferred to a control unit of the weaving machine which computes the position and/or length of the segments of treatment along each corresponding pile warp yarn.

Adjusting step d) comprises one or more of the following elementary steps, implemented after elementary step d1) as the result of this elementary step:

d2) varying the tension and/or yarn feed rate of at least one pile warp yarn, d3) incorporating at least one pile warp yarn into a backing fabric as a dead pile yarn, for one or several picks, d4) modifying a vertical distance between the two pile fabrics or d5) varying the operation sequence of the treatment unit on at least one pile warp yarn, as a function of the actual position of a previously applied segment on the same pile warp yarn.

During step c), the pile warp yarns alternate between the top and bottom fabrics and the method includes a subsequent step e) consisting in separating the top and bottom fabrics by cutting the pile warp yarns in order to create double legged tufts.

During step c), the pile warp yarns form loops around some internal weft yarns inserted in the shed outside each backing fabric of each pile fabric, on the front side of the fabric.

The segments applied at step b) vary along a direction parallel to a weft insertion of axis.

In a third aspect, the invention relates to a pile fabric presenting pile patterns on at least one side. This fabric can be woven according to the method mentioned here-above and on the weaving machine mentioned here-above. This fabric comprises a backing fabric woven with yarn sets, including at least two binding warp yarns and weft yarns in the warp yarns, and tufts interlaced in the backing fabric, belonging to a yarn set and forming each two pile leg portions on a front side of a backing fabric and at least a pile burl portion on a back side of the backing fabric. According to the invention, for a first pile tuft and a second pile tuft consecutive in a warp direction in a yarn set, at least one of the two first and second consecutive tufts includes two different segments with different colours on the same tuft, and the pile burl portion of the first tuft discloses a segment of a first colour from and the pile burl portion of the second tuft discloses a segment of the pile burl on the second tuft of a second colour, different from the first colour.

In the meaning of the invention, two consecutive pile tufts follow each other in the warp yarn directions. They have been woven from two different warp yarns during two successive picks of the weaving process. Alternatively, two consecutive pile tufts can follow each other in the warp direction of the same fabric even if they are not issued from two different warp yarns but from a single warp yarn.

According to further aspects of the invention, which are advantageous but not compulsory, such a fabric might incorporate one or several of the following technical features, taken in any admissible combination:

- A colour changing occurs gradually along a tuft portion between two segments of different colours of a tuft.
- A transition zone between two segments of different colours of a tuft is sharp, in particular in the form of a line surrounding the tuft.
- The transition zone is located at the burl and pile leg ends, preferably within the backing fabric.
- At least two neighbouring tufts, along a direction parallel to a weft insertion axis, have some identical graduation marks, in particular in the form of a ring surrounding the yarn, and the graduation marks of the two neighbouring tufts are located at a similar transition zone of segments along their respective tuft, in particular in the backing fabric.
- The tufts are made of cut pile.
- The tufts are made of pile loops on the pile side of the fabric, in particular bouclé tufts.
- At least one patterning pile yarn is interlaced in a backing fabric around three or more weft yarns consecutive in the warp direction, by turning externally around a first weft yarn, then internally around a second consecutive weft yarn before it turns externally around a third consecutive weft yarn.
- The yarn set includes no dead pile yarn.
- The fabric presents a pile pattern on its front side and a back pattern on its back side.
- The front side pattern and the back pattern are similar.

BRIEF DESCRIPTION OF THE SEVERAL VIEWS OF THE DRAWINGS

The invention will be better understood on the basis of the following description of one weaving machine, some weaving methods and some pile fabrics according to its principle, given by way of reference only in relation to the following figures where.

DETAILED DESCRIPTION OF THE INVENTION

Figure 1:
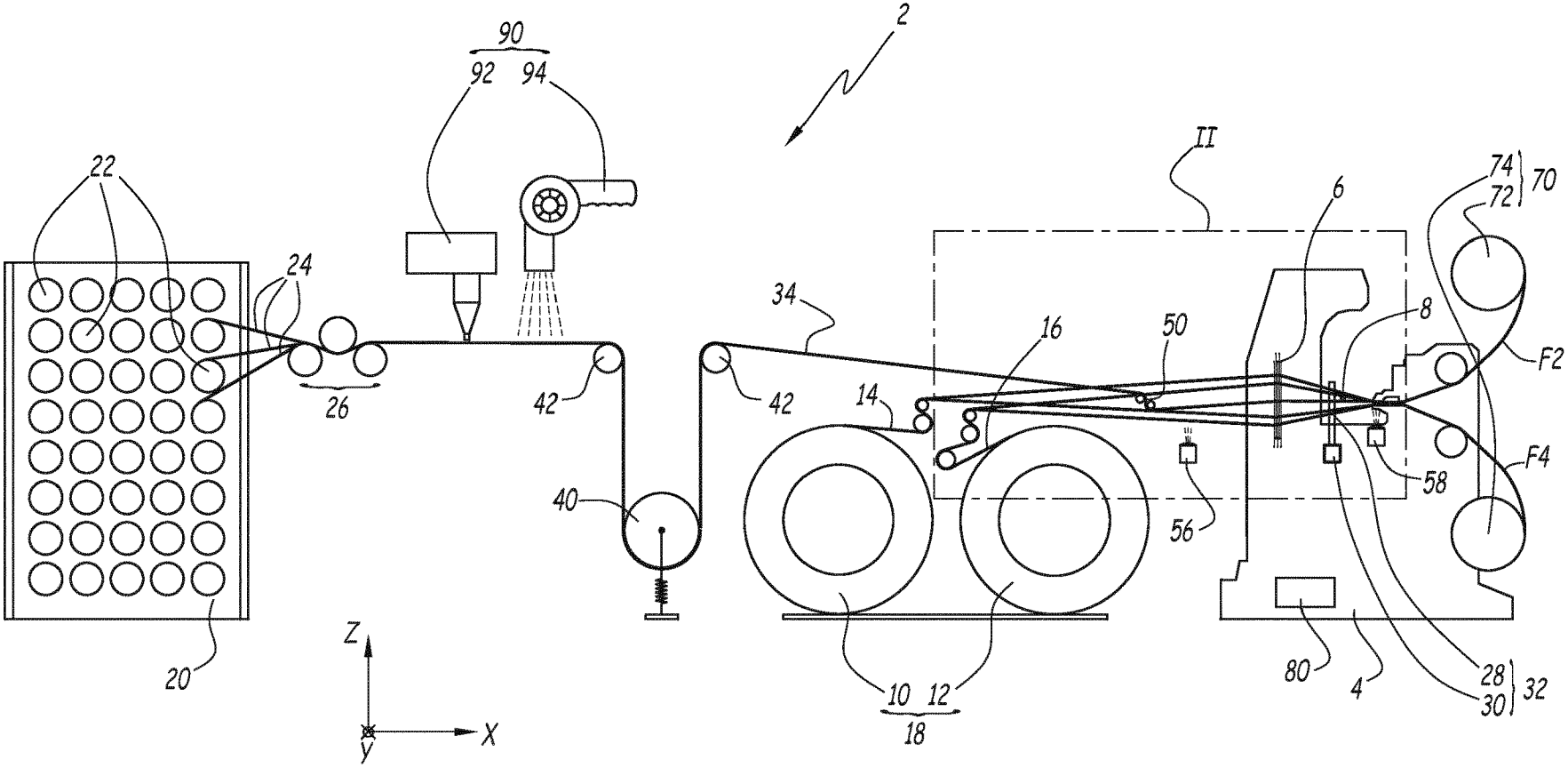
FIG. 1 is a side schematic view of a weaving machine according to the invention.
Figure 2:
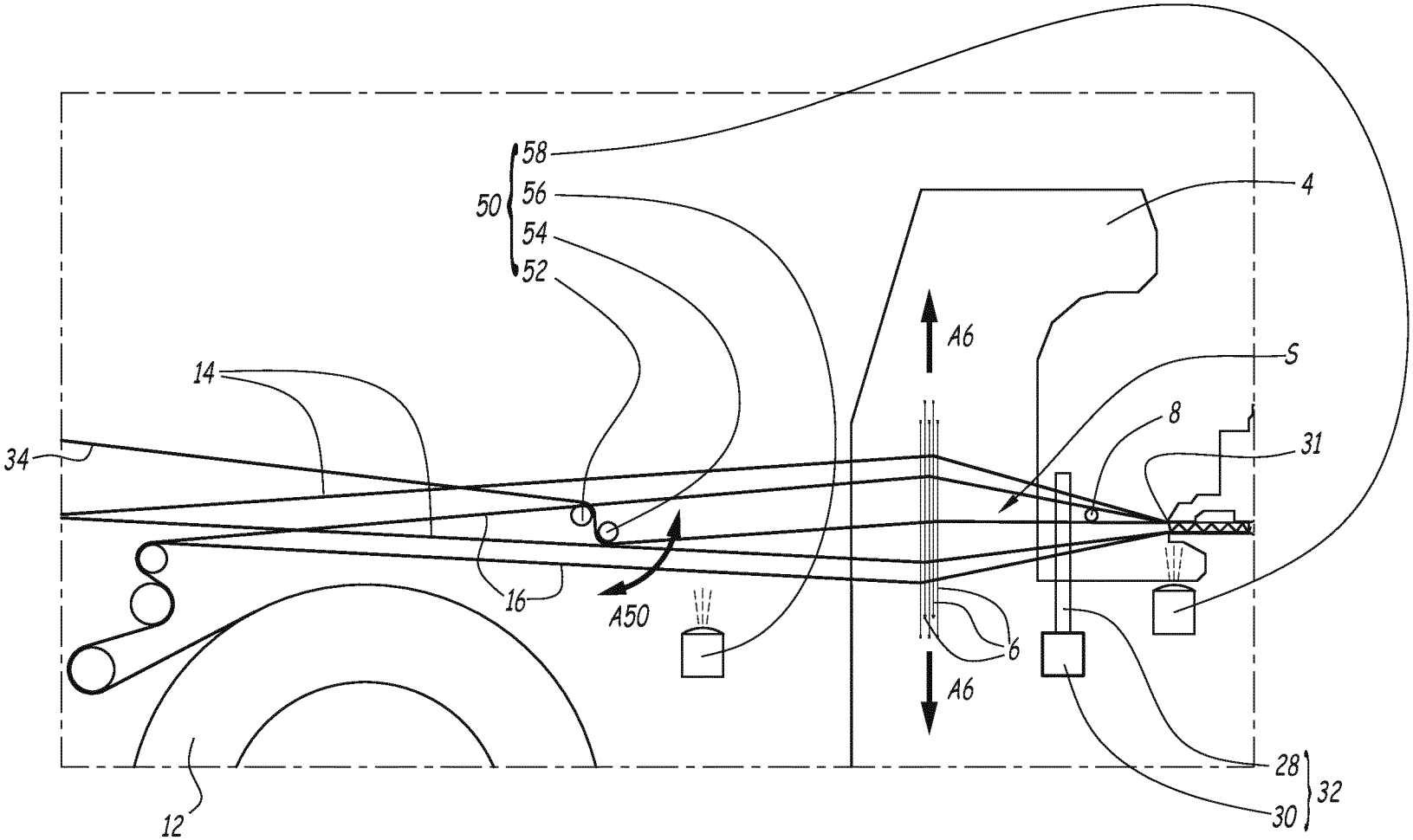
FIG. 2 is an enlarged view of detail II on FIG. 1.
Figure 3:
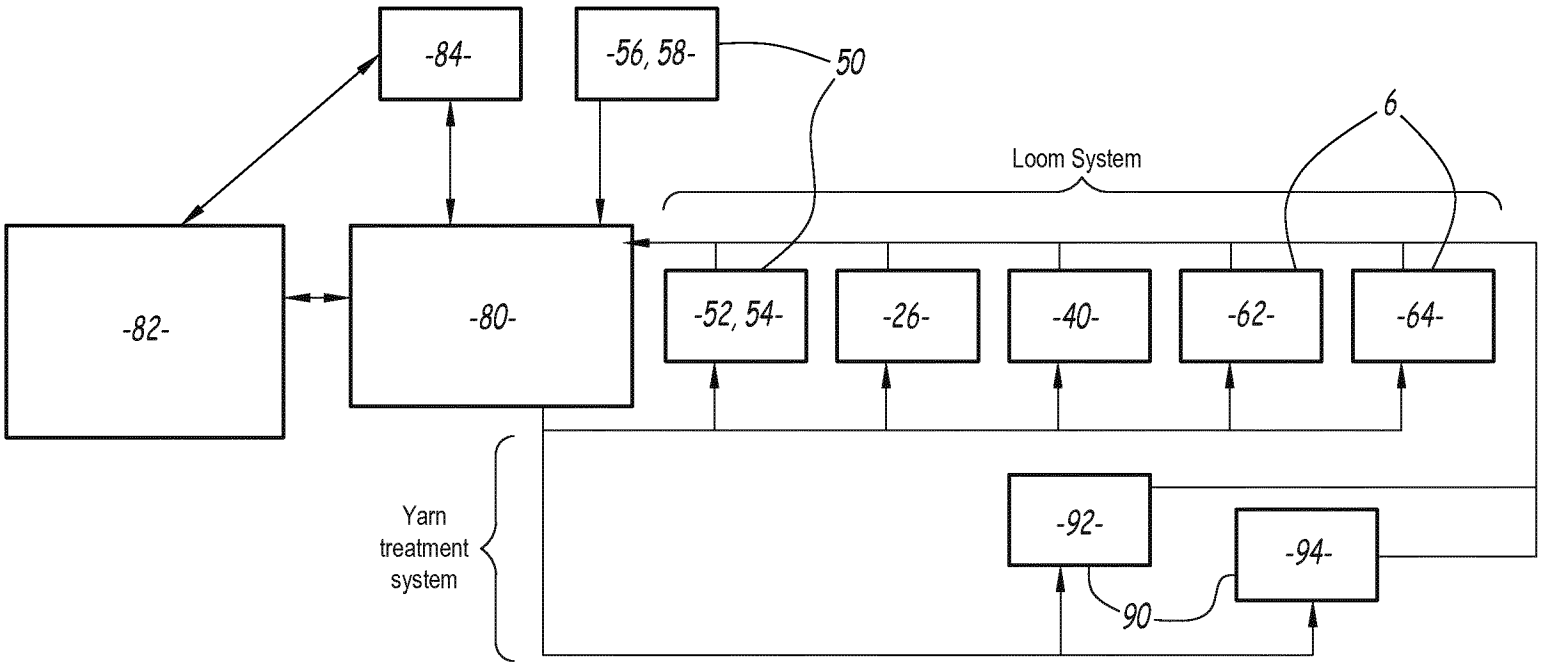
FIG. 3 is a scheme showing the connection between a control unit of the weaving machine of FIGS. 1 and 2 and its environment.

The weaving machine 2 represented on FIGS. 1 to 3 includes a weaving loom 4 equipped with a shedding unit 6 represented by heddles, these heddles being mounted on non-represented heddle frames and driven by a non-represented dobby or cam box. Alternatively, the heddles of shedding unit 6 are driven individually by at least one non-represented Jacquard machine. According to another variant, a dobby/cam box and a Jacquard machine can be used in weaving machine 2 for driving different sets of heddles. The reciprocating vertical movement of heddles is represented by arrows A6 on FIG. 2.

The heddles of shedding unit 6 are supposed to vertically move some warp yarns in order to constitute a shed S where a rapier 8 can be reciprocally moved in order to introduce weft yarns to be woven with the warp yarns going through the heddles of shedding unit 6. Rapier 8 belongs to a weft insertion unit for weaving machine 2.

Alternatively, two rapiers or more can belong to the weft insertion unit and several sheds can be constituted for the introduction of weft yarns. According to another approach, other weft insertion means than rapiers can be used.

One defines a longitudinal axis X of machine 2 as a horizontal axis along which the warp yarns extend in average, prior to entering shedding unit 6. Axis X is oriented in the same direction as the direction of progression of the warp yarns in weaving machine 2. One defines an axis Y which is orthogonal to axis X and horizontal. Weft insertion occurs along axis Y. Axis Y is oriented from the left to the right of the weaving machine when seen from its output side. One defines a vertical axis Z, orthogonal to axis X and Y and oriented upwardly.

Weaving machine 2 includes two beam rolls 10 and 12 from which two sets of binding warp yarns 14 and 16 are unwound in order to be fed to weaving loom 4. Beam rolls 10 and 12 together form a binding warp yarn feeding unit 18 for weaving machine 2.

Alternatively, the binding warp yarns 14 and 16 could come from the creel so that the creel is a pile and binding warp yarn feeding unit. In such a case, pile yarn feeding unit 20 and binding yarn unit 18 are made by the same part of weaving machine 2.

Weaving machine 2 also includes a pile warp yarn feeding unit 20 made of a creel provided with several bobbins 22 equipped with yarns 24 to be used for forming piles or tufts on the top pile fabric F2 and bottom pile fabric F4 woven on weaving machine 2. On FIG. 1, only three pile warp yarns 24 are represented between some bobbins 22 and a yarn feeder 26 made of several friction rollers driven by non-represented electric motors and capable of pulling pile warp yarns 24 out of bobbins 22. In practice, one pile yarn can extend from each bobbin to yarn feeder 26. Yarn feeder 26 forms a drawing-in unit for drawing the pile warp yarns 24 from the creel 20.

Alternatively, several drawing-in units and other types of units can be used with weaving machine 2 like multi-pulley systems conducting the yarns through the unit, gripping rollers, or a transport mechanism unit where yarn sets can be driven by displaceable rollers, which apply an adjusted force, by the gravity of a roller, by friction of the rollers, or by varying the feed rate of the yarns through the unit. The number of rollers of such a unit can be equal to 2 or larger than or equal to 4.

Weaving machine 2 also includes a reed 28 driven by a sley 30. Items 28 and 30 together form a beating up mechanism 32 for beating the weft yarns into the shed, at a beating point 31.

34 denotes the reference of the warp sheet made by the juxtaposition of pile warp yarns along axis Y between yarn feeder 26 and shedding unit 6.

Yarn feeder 26 is designed to provide a uniform or near uniform tension of the warp yarns 24 along the weft of the warp sheet 34, that is along a direction parallel to axis Y. This is obtained thanks to the friction rollers which apply the same stretch on the whole warp yarns unwinding from the creel, along an axis parallel to the weft insertion axis Y.

A buffer mechanism 40 is located on the path of warp sheet 34 between yarn feeder 26 and shedding unit 6. Buffer mechanism 40 compensates fluctuations in the progression of the warp sheet, these fluctuations being due to the movements of the heddles of shedding unit 6 and to the movements of reed 28 in weaving loom 4. Buffer mechanism 40 provides a constant warp yarn speed along the path of warp sheet 34. Buffer mechanism is connected to the ECU unit 80 for storing yarn material at a controlled quantity, and at a controlled speed.

Alternatively, the buffer mechanism can operate mechanically with elastic means in a passive way, without being actively driven by the ECU.

Still alternatively, the treatment unit 90 can anticipate and compensate some fluctuations of the shedding unit 6 by varying the operation sequence: for example while the shedding speed rises, the printing head can apply the ink more quickly or in a shortened sequence for the warp pile pattern to be respected as the speed of the warp sheet rises, and for the printed pattern to approach the required pattern as much as possible. Alternatively, the adjusting sub-assembly 50 contributes to compensate the yarn speed fluctuations due to shedding and beating-up.

Moreover, in the situation of a loom stop, which can occur in case of detection of a yarn breaking, the running of the yarns downstream of the buffer should stop, like the shedding operations stop. Meanwhile, the printing operation can continue for a period needed to end the application of treatment on some warp yarns. Thus time for the printing cycle can be completed. Inversely, in the situation of the loom start, the operations are reversed so that the shedding should start before the printing unit warms up and starts its printing cycles. The start of the printing operations can occur after some preliminary operations, while the loom starts the shedding operations.

So, by storing pile warp yarns respectively before or after the mentioned printing operations, the buffer compensates the running of the warp yarns between the printing unit and the shedding unit while their respective yarn running is not the same. In other words, the buffer mechanism 40 stores some pile warp yarns 24 while the treatment unit 90 runs faster than the shedding unit, and it provides some pile yarns while the shedding unit runs faster than the treatment unit. The buffer compensates simultaneously the running of the warp yarns for the top fabric F2 and for the bottom fabric F4.

Weaving machine 2 also includes some pulleys 42 which form guiding means for the warp yarns 24 of warp sheet 34. Warp yarns 24 can be guided as a spread sheet under the treatment unit 90. In particular the yarn feeder 26 is provided to apply a uniform tension to the spread sheet along the weft of the warp sheet between the yarn feeder and the pulleys 42, or between the yarn feeder and the buffer mechanism 40. In order to allow application of different colour inks onto two neighbouring pile warp yarns 24, separation means are used for separating the warp yarns from each other. For example, a non-represented reed can settle the warp yarn gap in a direction parallel to axis Y, at a set distance defined by the teeth module of the reed, which particularly helps the neighbouring warp yarns belonging to two different patterns not to be affected by the wrong colours during the treatment step.

Weaving machine 2 also includes at least one adjusting sub-assembly 50 which includes two sets of rollers 52 and 54 interposed on the path of warp sheet 34, between yarn feeder 26 and shedding unit 6. The location of rollers 52 and 54 along this path may be adjusted via non-represented electric motors, in particular in rotation around an imaginary axis parallel to axis Y and located between rollers 52 and 54, as shown by arrow A50. Also, the path of the warp yarns between the two rollers can be varied. Thus, adjusting sub-assembly 50 allows changing the length of the path of warp sheet 34 between yarn feeder 26 and shedding unit 6, which has an influence on the speed, feed rate and/or tension of the warp yarns 24 downstream of adjusting sub-assembly 50 and upstream of beating point 31. Adjusting sub-assembly 50 can be controlled by ECU 80 to slacken or stretch the pile warp yarns 24 during at least one pick of the shedding unit 6 in order to relocate a transition zone with respect to the inserted weft yarns. By downstream, one means "after adjusting sub-assembly 50" in the direction of movement of pile yarns 24. This definition of "downstream" applies mutatis mutandis to all other occurrences of this word. Upstream should be understood as opposite to downstream in the direction of movement of pile yarns 24.

Alternatively, the path of the pile warp yarns 24 may remain the same and adjusting sub-assembly 50 varies a friction effort applied by rollers 52 and 54. This may occur by installing these rollers in contact with each other and by varying a contact force between these rollers.

Alternatively or in addition, the adjusting sub-assembly 50 can include individual actuators driving individual heddles for deviating pile warp yarns from their normal path, which also allows adjusting the path length, thus the speed and/or tension of the warp yarns downstream of yarn feeder 26. Such individual actuators might be similar to the ones disclosed in EP-A-1 069 218 or EP-A-1 491 669.

Adjusting sub-assembly 50 also includes two cameras 56 and 58 which are respectively located and oriented in order to take pictures of the warp sheet 34 and of at least one of the two fabrics F2 and F4, near the beating point. In the example of the figures, camera 56 takes photos of the back side of fabric F4. Alternatively, one or several other cameras can be used to take photos of the back side of fabric F2 and/or the front sides of the fabrics, or a scanner moving along an axis parallel to Y.

Alternatively, one or several optical sensors or cameras of the adjusting sub-assembly 50 can be set on the path of warp sheet 34, between yarn feeder 26 and shedding unit 6 of the weaving machine 2, For example a sensor can be settled on the treatment unit 90 in order to monitor the printing sequence, the printed pattern and/or any yarn breakage of the pile yarns.

The adjusting sub-assembly 50 operates simultaneously for monitoring and adjusting the patterns of the warp yarns for the top fabric F2 and for the bottom fabric F4.

Weaving machine 2 also includes a take up system 70 which comprises two beams 72 and 74 for winding fabrics F2 and F4 on the outlet side of weaving machine 2. These beams 72 and 74 are driven by non-represented electric motors.

Weaving machine 2 also includes an electronic control unit or ECU 80 which is capable of piloting most components of weaving machine 2 and synchronize them. As shown on FIG. 3, ECU 80 is associated with a human computer interface or HMI 82, which can be formed of a screen, a key board and/or a mouse. ECU 80 is also associated with a memory 84 which includes data relating to required final colour patterns to be obtained on fabrics F2 and F4 with pile warp yarns, that is with tufts embodied in the fabrics. These required final colour patterns are visible on the front side and also on the back side of each fabric.

As shown on FIG. 3, electronic control unit is connected to adjusting sub assembly 50, yarn feeder 26, buffer 40 and to a dobby machine 62 and a Jacquard machine 64 which also belongs to shedding unit 6.

Alternatively, one or more buffers could be used along the path of the pile warp yarns to compensate the tension fluctuations.

Alternatively the drawing-in unit 26, the buffer 40, and/or the adjusting sub-assembly 50 might be combined in a non-represented multifunctional unit which can operate one or several of the respective drawing-in, compensating and adjusting operations of the weaving machine.

Weaving machine 2 also includes a treatment unit 90 which might be so-called "yarn treatment unit" and which is located, along the path of the warp yarns 24 and warp sheet 34, between yarn feeder 26 and shedding unit 6, as shown on FIG. 1. Treatment unit 90 includes a digital printer 92 and a fixing unit, like a dryer 94, located downstream of printer 92 for drying the ink applied by printer 92 onto pile warp yarns 24.

Preferably, the printer 92 is an ink jet printer or a printer delivering droplets of ink on pile warp yarns 24 by gravity and electromagnetically controlled.

According to an optional aspect of the invention which is not represented, treatment unit 90 can also include a pre-treatment device located upstream of printer 92, in order to prepare the warp yarns 24 before printing, so as to improve the fixation of ink onto the warp yarns 24. For instance, this pre-treatment device can incorporate another dryer, or a chemical applicator for changing the PH of the yarns, or for changing the viscosity of the ink delivered by the treatment unit.

Alternatively, the non-represented pre-treatment device or the fixing unit 94 can include a steamer, heat rollers, a microwave generator, or an ultraviolet generator applying on pile warp yarns any operations associated to the ones performed by the printer unit 92.

Alternatively, the pre-treatment device and/or the fixing unit 94 can be part of the treatment unit 90.

As shown on FIG. 3, control unit 80 also controls components 92 and 94 of treatment unit 90.

As visible on FIG. 3, control unit 80 gets a feedback signal from parts 50, 26, 40, 62, 64, 92 and 94, which improves the precision of the control of these parts forming the loom system.

Alternatively individual or mutual control units might control the components of the yarn treatment unit 90 and the components of the loom system represented on FIG. 3.

The structure of weaving machine 2 explained here-above allows applying on warp yarns 24, coming out of yarn feeder 26, some segments of differently coloured inks, in order to obtain pile tufts of different colours, in directions parallel to axes X and Y, in fabrics F2 and F4.

Figure 4:
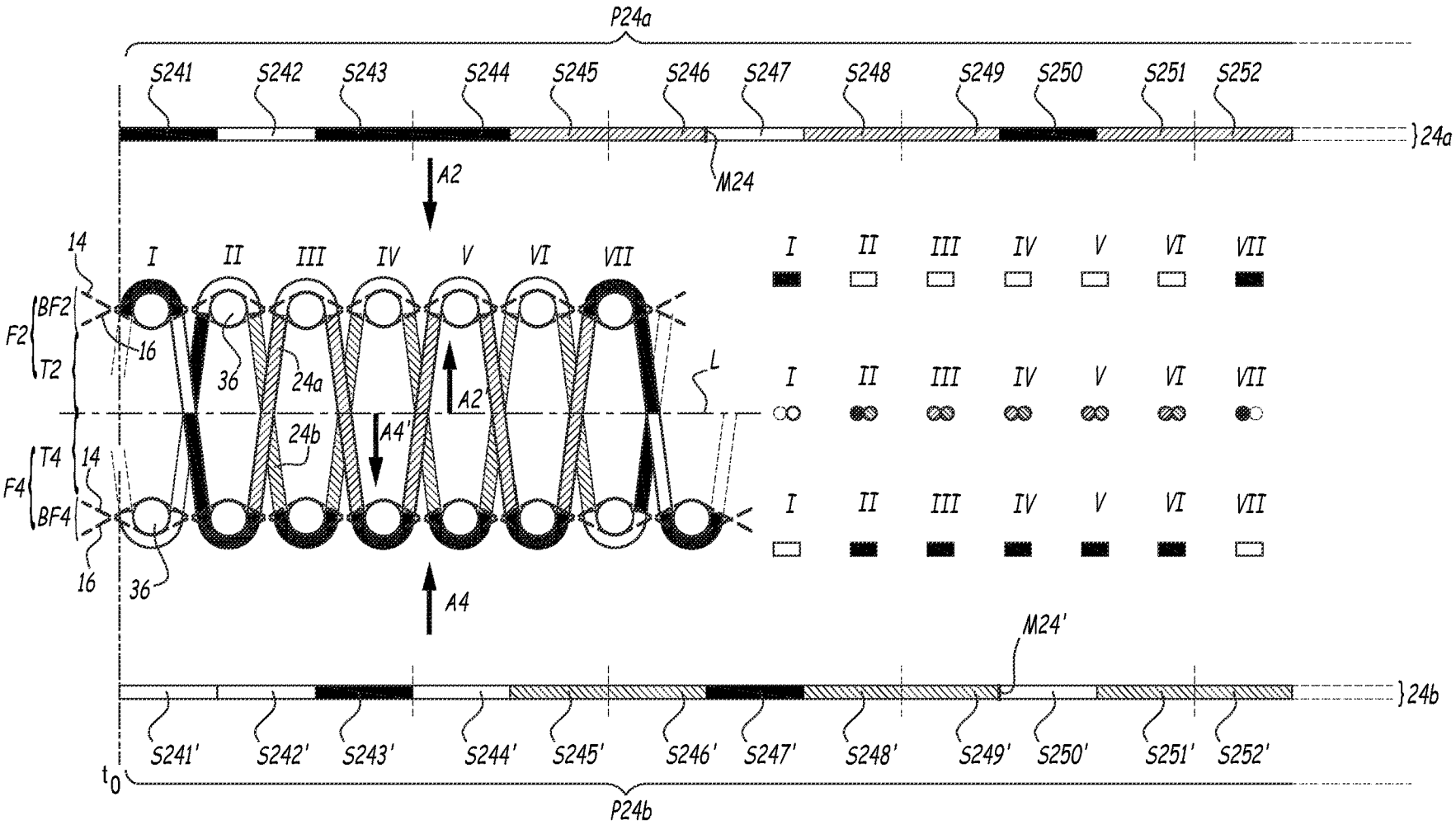
FIG. 4 is a schematic view showing two pile warp yarns interlaced into two pile fabrics during seven consecutive picks. This figure also shows colour patterns applied on these two yarns or their part corresponding to seven picks I to VII. This figure also shows, on the right, the colour repartition of some tufts created in the corresponding pile fabrics.

More precisely, as shown on FIG. 4 for picks I to VII, with pick I starting at an instant to, different segments of colours can be applied on two different pile warp yarns 24*a* and 24*b*. In the example of FIG. 4, three colours are used, namely black, white and grey which is represented by hatchings on FIG. 4 to 7.

Pile warp yarn 24*a* is dyed by printer 92 with the pattern P24*a* visible on top of FIG. 4 including a first black segment S241, a second white segment S242, a third black segment S243, a fourth black segment S244, a fifth grey segment S245, a sixth grey segment S246, a seventh white segment S247, an eighth grey segment S248, a ninth grey segment S249, a tenth black segment S250, an eleventh grey segment S251, a twelfth grey segment S252 and so on. Similarly, second pile warp yarn 24*b* is dyed with a first white segment S241', a second white segment S242', a third black segment S243', a fourth white segment S244', a fifth grey segment S245', a sixth grey segment S246', a seventh black segment S247', and an eighth grey segment S248', a ninth grey segment S249', a tenth white segment S250', an eleventh grey segment S251', a twelfth grey segment S252' and so on.

Thus, when pile yarns 24*a* and 24*b* are interlaced with weft yarns 36 introduced in the shed by rapier 8, one can obtain the repartition of colours represented on the left of FIG. 4.

Top pile fabric F2 is made by the upper part of the yarns represented on the left of FIG. 4 and includes a backing fabric BF2, where weft yarns 36 are inwoven with binding warp yarns 14 and 16 and where pile warp yarns 24*a* and 24*b* form pile burls around the weft yarns 36 of the backing fabric BF2, on the backside of top pile fabric F2. Top pile fabric F2 also includes tufts T2 which extend away from backing fabric BF2, on the front side of pile fabric F2.

Similarly, bottom pile fabric F4 includes a backing fabric BF4 made of binding warp yarns 14 and 16, weft yarns 36 and tuft burls. Bottom pile fabric F4 also includes a tuft portion T4 which extends away from backing fabric BF4, on the front side of bottom pile fabric F4.

The binding warp yarns might also be so-called "ground warp yarns" like the backing fabric might also be so-called "ground fabric".

The succession of segments S241 to S252, and so, on pile warp yarn 24*a* together form printed pattern P24*a* on this yarn. Similarly, the succession of segments S241' to S252', and so on, together form a printing pattern P24*b* on warp yarn 24*b*.

In each pile fabric F2 of F4, a tuft includes two legs which extend mainly from the backing fabric and a burl portion which turns around a corresponding weft yarn 36 and whose ends can extend slightly out of the backing fabric. The fabric has double legged tufts.

The burl portion can be read as the pile portion turning around the weft yarn 36 with the toe portions of the pile legs of the same colour which can slightly extend out of the backing fabric at the bottom of the pile legs. In other words, if one considers a transition zone between a burl segment and a pile leg segment, this zone may be out of the backing fabric along the pile leg portion. The burl portion and the transition zones should not be visible from the pile side of the final fabric unless the fabric is manipulated and the tufts are handled by separating the pile legs.

As shown on FIG. 4, these three parts of a tuft can have different colours, as shown for example by segments S243', S244' and S245' of pile warp yarns 24*b*. Two transition zones are visible on FIG. 4, between segments S243' and S244' and between segments S244' and S245'. Alternatively, the segment of the burl portion and one of its two pile legs can have the same colour, like segments S243 and S244 while segment S245 has another colour. The transition zone is visible between segments S244 and S245 as a sharp line surrounding the tufts, at the ends of two segments of different colours. One considers that the transition zone between the pile and burl segments corresponds to the limit between the pile burl portion and the pile leg portion in this embodiment. Some transition zones exist before the separation of the two face-to-face fabrics between the pile tops of the tufts issued from the same pile warp yarn, for example between segments S242' and S243'.

The pile repartition represented on the left of FIG. 4 corresponds to the position of the different yarns downstream of the beating up mechanism 32 and prior to implementation of a cutting step where pile yarns are cut along a horizontal line L.

The right part of FIG. 4 represents what a user sees in fabrics F2 and F4, more precisely their parts corresponding respectively to picks I to VII, at the level of the pile yarns 24 and 24*b* along axis Y. The upper portion of the right part of FIG. 4 represents what the user sees in the direction of arrow A2 on the left part of this figure. Similarly, the lower portion of the right part of FIG. 4 represents what the user sees of fabric F4 in the direction of arrow A4 on the left part of FIG. 4. The medium portion of the right part of FIG. 4 represents what the user sees on the front side of fabric F2, in the direction of arrow A2' once the pile warp yarns have been cut along line L and have come to a substantially vertical orientation according to which two pile legs formed at a given pick extend next to each other. Moreover, all the pile legs of the pile warp yarns 24*a*, 24*b* belonging to the same yarn set are, after the cutting step, aligned along a direction parallel to axis X, as shown by the fact that the tuft sections are horizontally aligned on the middle right part of FIG. 4.

Figure 5:
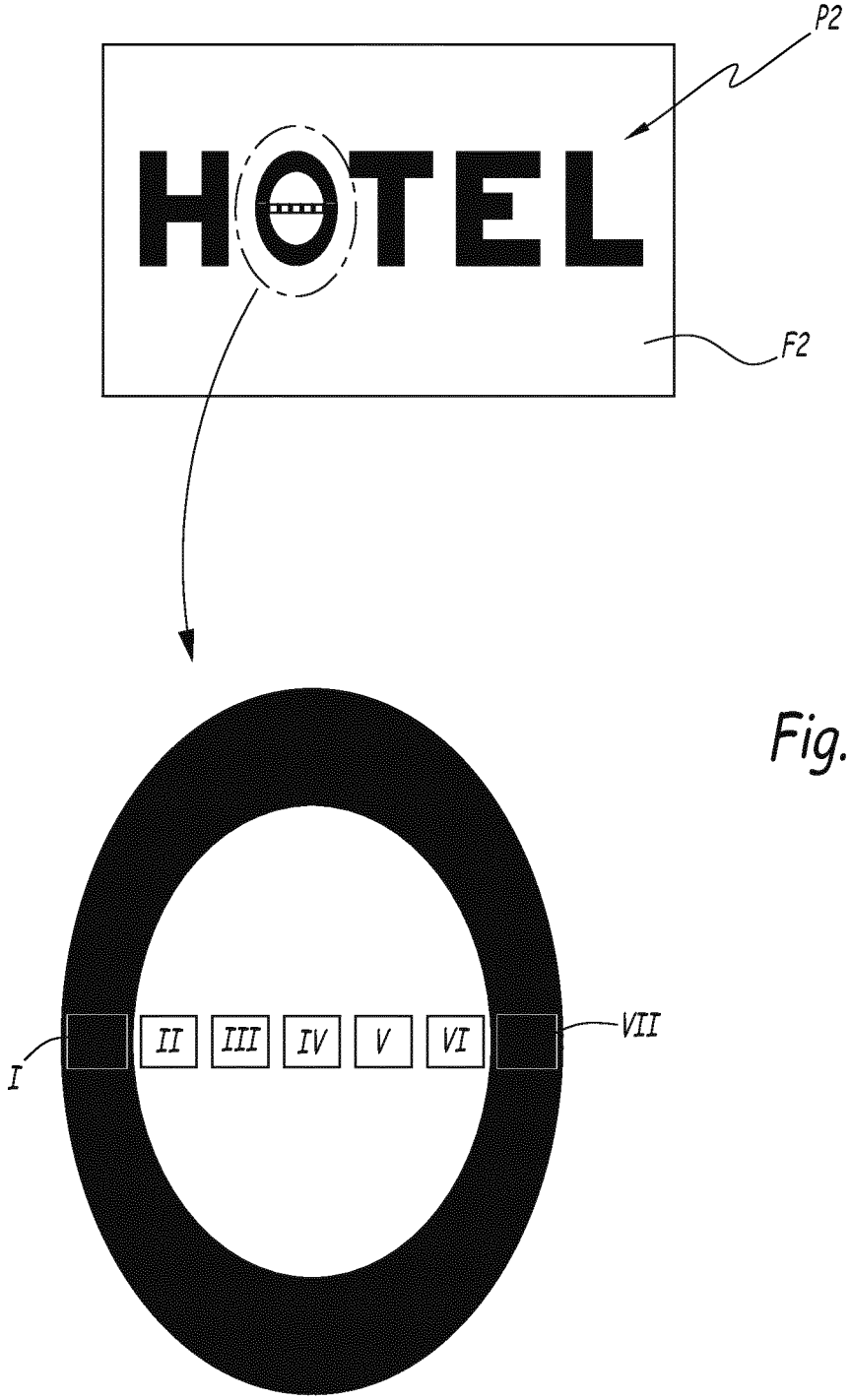
FIG. 5 shows the backside of a top pile fabric manufactured on the machine of FIGS. 1 to 3, this fabric including a pattern made by tuft burls in picks I to VII.
Figure 6:
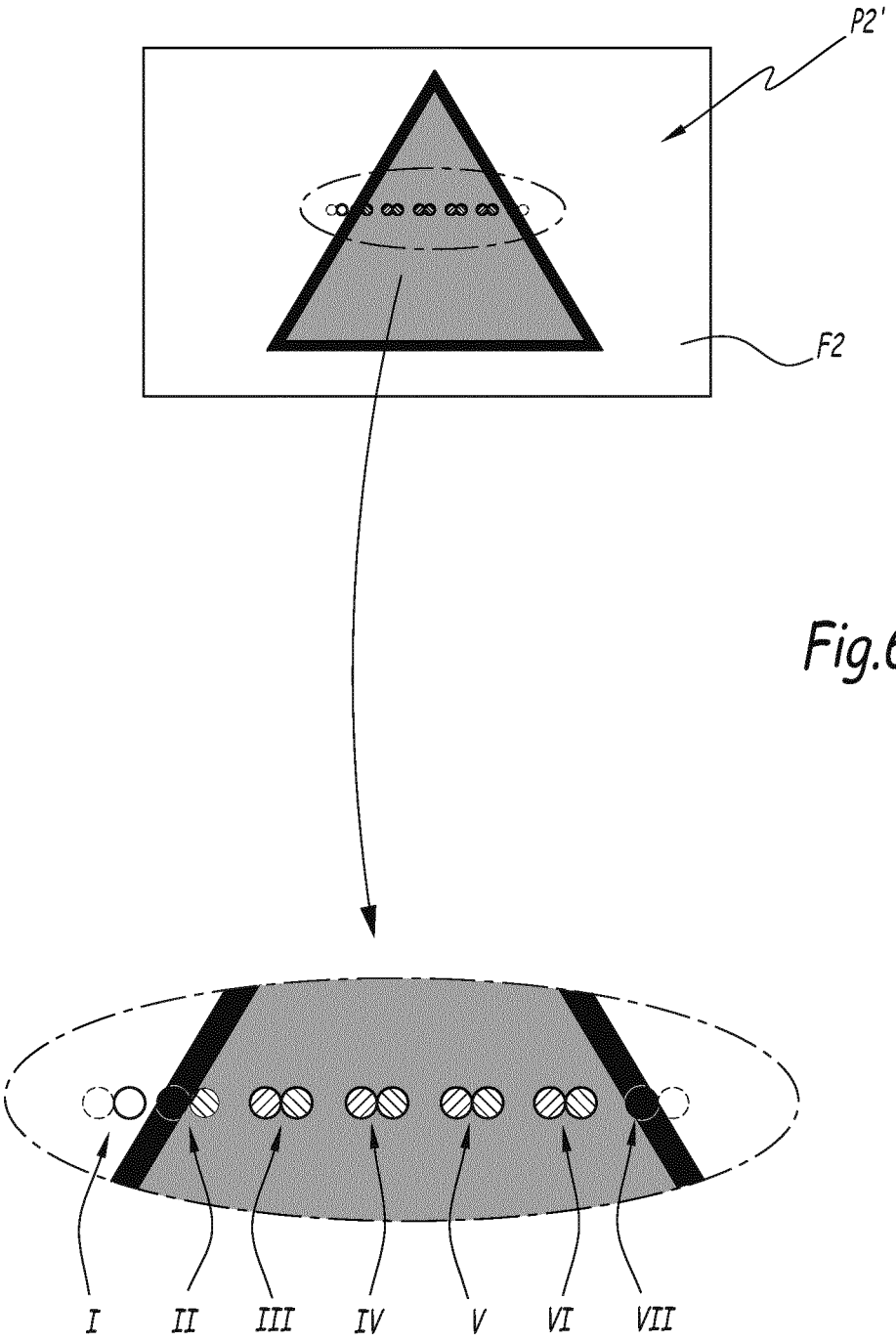
FIG. 6 is a front view of the top pile fabric of FIG. 5 with a pattern made by the tuft legs of tufts in picks I to VII.
Figure 7:
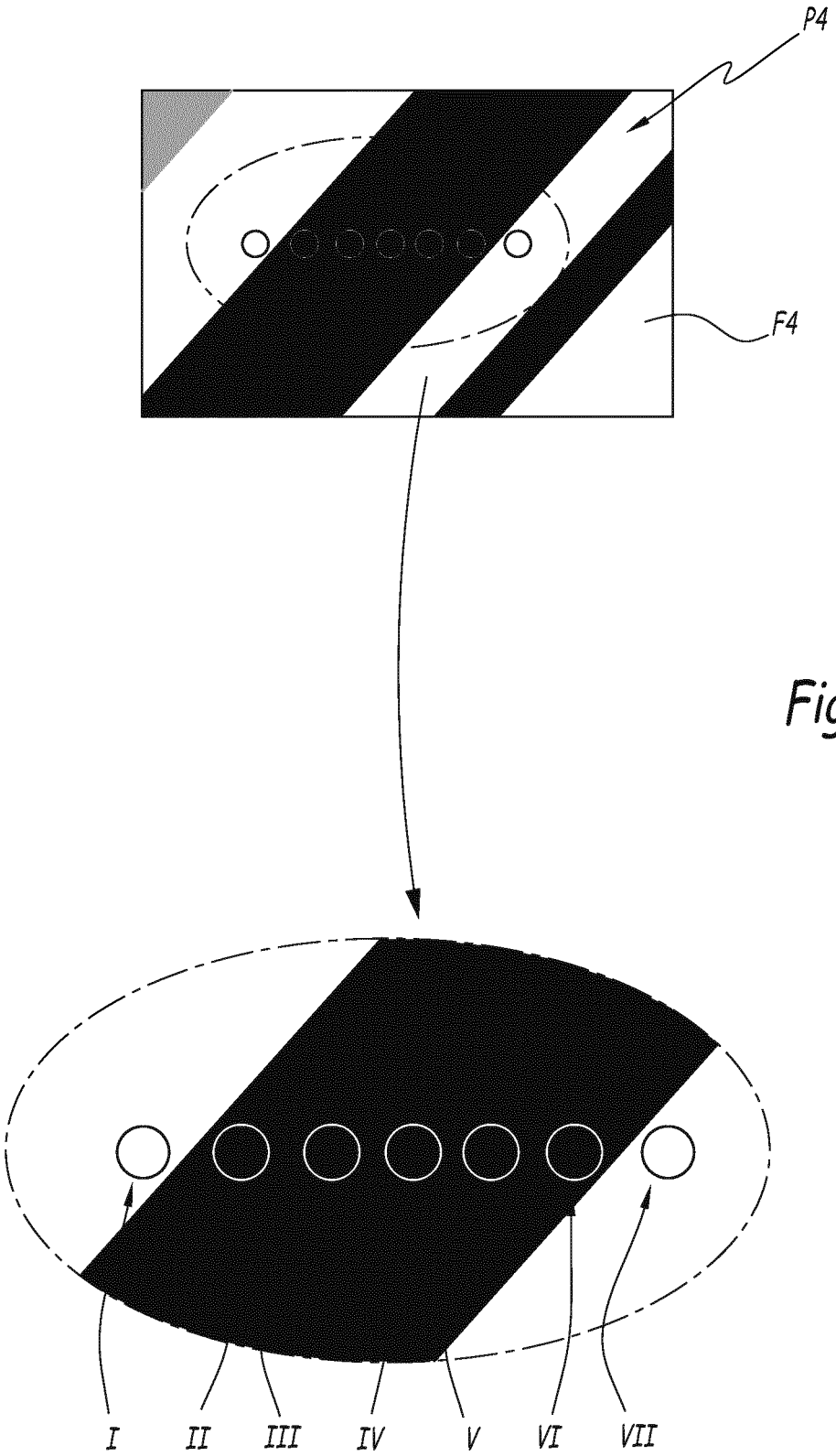
FIG. 7 is a view of the back side of a bottom pile fabric manufactured on the machine of FIGS. 1 to 3 which includes a pattern made by tuft burls in picks I to VII. The front view of this fabric is similar to FIG. 6.

As can be deduced from the comparison of FIG. 4 with FIGS. 5 to 7, picks I to VII allow obtaining different patterns on the respective front and back sides of pile fabrics F2 and F4. More precisely, picks I to VII allow forming the centre portion of letter O in a black pattern P2 representing the word "HOTEL" on the back side of pile fabric F2. The zoom of FIG. 5 shows that picks I and VII correspond to black tuft burls, which form a part of the letter O, whereas picks I to VI form white tuft burls belonging to the white background of pattern P2. By considering the yarn set of top pile fabric F2 before separation from bottom pile fabric F4, different segments of colours are for example visible on the consecutive tufts on pick I, pick II, pick III . . . pick VII of fabric F2 on the same fabric F2, and the pile burl portion of the pile burl of pick VI discloses a white segment of different colour from the segment of the pile burl portion of the second consecutive tuft of pick VII. The same approach can be conducted by considering the white pile burl portion of pick V and the black pile burl portion of pick VII coming from the same pile warp yarn 24*a*. The consecutive segments of pile burl portions of colour make it possible to have a back pattern P2 on the top pile fabric F2.

Similarly, FIG. 7 and the corresponding zoom show that picks I to VII allow forming a part of two black stripes of a requires pattern P4 of several black, white and grey stripes on the back side of pile fabric F4.

On the other hand, the cut piles of fabric F2 form, with their portions corresponding to picks I to VII, a horizontal portion of a grey triangle bordered by a black contour, which belongs to a pattern P2' to be made on the front side of fabric F2.

One understands that another pattern is created on the front side of pile fabric F4 by the tuft portion T4 when seen in the direction of arrow A4'. This other pattern does not need to be symmetric with pattern P2'.

Thus, by applying printed patterns P24*a* and P24*b* on yarns 24*a* and 24*b* and corresponding printed patterns on the other yarns of warp sheet 34, it is possible to create any required pattern on the front and back sides of top and bottom pile fabrics F2 and F4. These required patterns can be designed independently from each other, which provides a great flexibility for the design and manufacture of these fabrics.

Moreover, since a pile warp yarn can be used for forming tufts of different colours, the pile warp yarn consumption can be decreased as compared to prior art approaches. Since no pile warp yarns has to be buried as dead yarn in the backing fabric, the binding structure can be simplified, which also slightly decreases the binding warp yarn consumption.

From a process point of view, when final patterns P2, P2', P4 and equivalent have been designed, they can be provided to ECU 80 via interface 82 or uploaded from memory 84. It is then possible for a microprocessor of electronic control unit 80 to compute the printed pattern P24*a*, P24*b* . . . or equivalent to be applied on each pile warp yarn 24. In other words, prior to weaving pile fabrics F2 and F4, one determines the printed pattern P24*a*, P24*b*, . . . of each pile warp yarn 24 on the basis of the required pile pattern P2, P2', P4 or equivalent.

On this occasion, one can make a difference between the pile segments of each printed pattern P24*a*, P24*b* . . . that will be incorporated respectively into top pile fabric F2 and bottom pile fabric F4. The transition zones between these pile segments belonging to their respective fabrics can be monitored by the adjusting sub-assembly 50.

For instance, one can identify segment S242, S246, S248 and S252 as dedicated to pile pattern P2'. The same applies for segments S243', S245', S249', S251'. Similarly, segments S243, S245, S249, S251, S242', S246', S248' and 252 can be identified as dedicated to the pile pattern in pattern fabric F4.

Similarly, segments S241, S247, S244', S250' can be identified as dedicated to the back side pattern P2 of the top pile fabric F2, whereas segments S244, S250, S241' and S247' can be identified as dedicated to the back side pattern P4 of bottom pile fabric F4.

Figure 8:
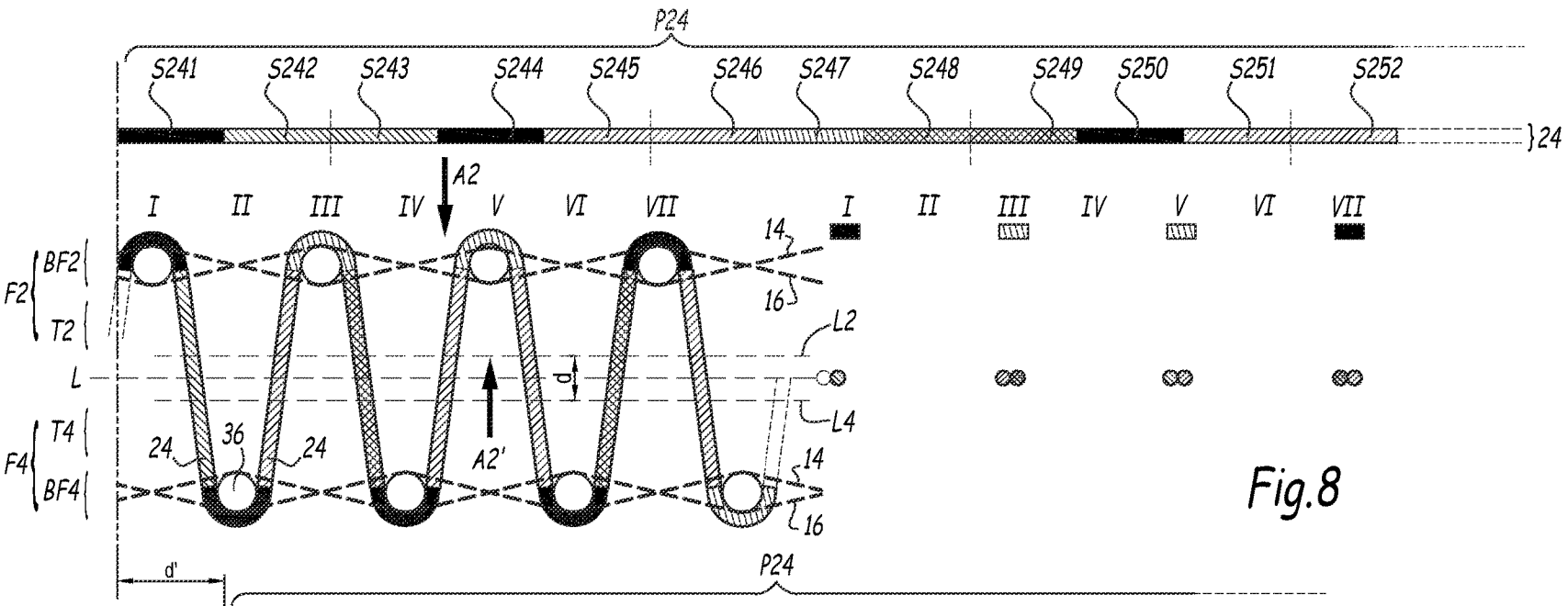
FIG. 8 shows the path of a correctly positioned pile warp yarn during seven consecutive picks, with the same presentation as FIG. 4 for this single warp.

FIG. 8 shows a single pile yarn 24 patterning between top pile fabric F2 and bottom pile fabric F4 and having a printed pattern P24 represented on the top portion of FIG. 8. As this printed pattern is correctly positioned with respect to weft yarns 36, one can have the repartition of colours represented on the right of FIG. 8.

The camera 58 can monitor an offset or a elongation of the segments or an offset of the transition zones; an offset is visible, along an axis parallel to the weft insertion axis Y, for all the pile warp yarns. Detection of such an offset or an elongation should induce adjustment of the tension of all the pile warp yarns 24 to come back to the normal situation.

Four colours are used in printed pattern P24, namely black on segments S241, S244, S250 and so on, yellow represented with hatchings in a first direction in segments S242, S243 etc . . . , green represented with hatchings in a second direction in segments S245 and S246 and blue represented with crossed hatchings in segments S248 and S249.

In practice, and in order to avoid colour mixing between segments of pile legs having different colours in the two-pile fabrics, like segments S242 and S243 or S242' and S243' in the example of FIG. 4, pile yarns are cut along line L and sheared along two lines L2 and L4 parallel to line L, as represented on FIG. 8. The shearing operation is conducted along lines L2 and L4 after weaving on a machine different from weaving machine 2. This shearing operation is known per se. The vertical distance d between these two lines is exaggerated on this figure for better understanding. The segments of colour of the consecutive tufts on the backside of the backing fabric BF2 for the consecutive pick I and III are different from each other. The opposite, but similar, feature exists for the consecutive pick V and pick VII. A visible pattern can be made on the backside of the top pile fabric F2 with such variations of segments of colour for the consecutive pile burls of the tufts.

Figure 9:
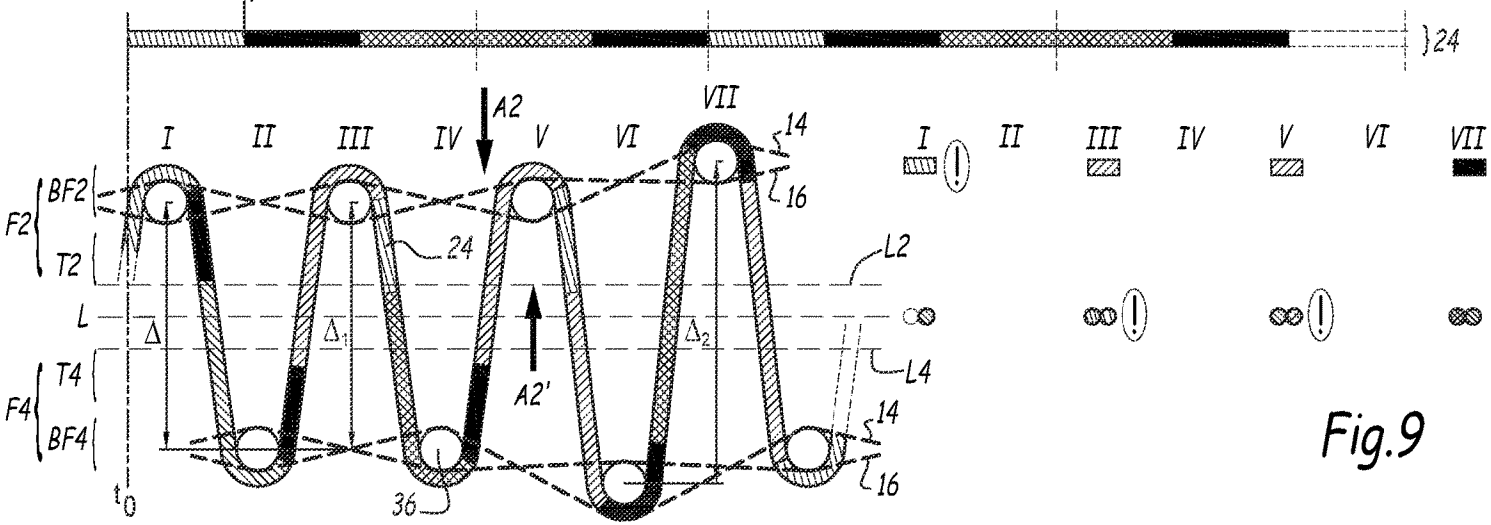
FIG. 9 shows the same information for the same warp yarn when it is offset with respect to its normal position with respect to the weft yarns.
Figure 10:
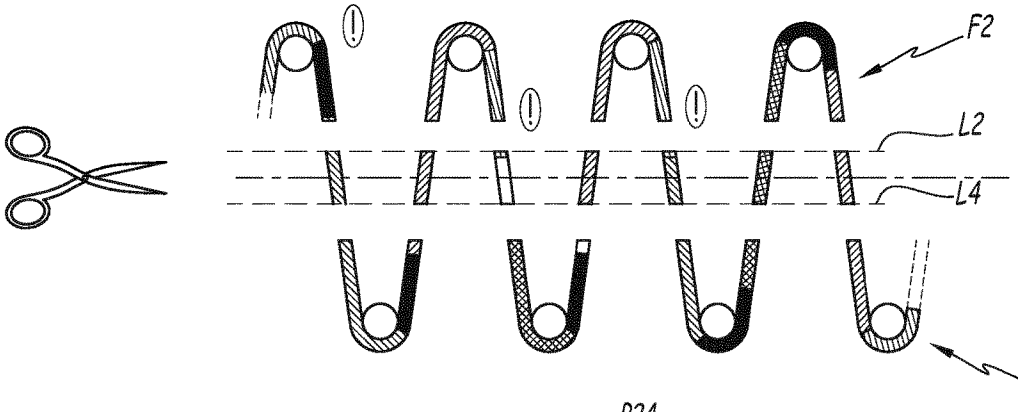
FIG. 10 represents the situation of the pile of FIG. 9 once its pile warp yarns have been cut in order to form tufts.

As shown on FIG. 9, in case the beginning of segment S241 is offset from the beginning of pick I materialized by instant to, as shown by distance d' on this figure all segments are offset with respect to their nominal position so that, when pile yarn 24 is woven, cut along line L and sheared along lines L2 and L4 as shown in FIG. 10, one obtains the pattern schematically represented on the right of FIG. 9 which is incorrect as compared to the one represented on the right of FIG. 8. The tufts incorrectly colored are identified with an exclamation point on FIGS. 9 and 10 like a visible default on the final fabric corresponding to a monitored default for the adjusting sub-assembly 50 on the weaving machine 2, preferably monitored close to the beating point 31 of the shedding unit 6.

Actually, such an offset configuration can be detected by cameras 56 and 58 either prior to or after weaving. In particular, if camera 58 is located above pile fabrics F2, it allows detecting an offset and some errors in the back pattern P2.

The information sent by cameras 56 and 58 is provided to control unit 80 which can compare it to the required final pattern stored in memory 84 and, in case of an offset, send a warning message via interface 82 and take proper measures by adjusting the path of the warp sheet 34 thanks to a movement of rollers 52 and 54 in the direction of arrow A50 or by changing the distance between these two rollers. This allows modifying the path of the warp yarns realigning printed pattern P24 on the picks, in order to come back to the normal situation represented on FIG. 8.

In practice, control unit 80 does not wait for the situation to be as bad as the one represented on FIG. 9 and may react as soon as one pick generates a default in the patterns obtained on the front side or on the back side of either one of the pile fabrics F2 or F4. The adjusting sub-assembly 50 and the ECU 80 identify a default and drive accordingly one or several adjusting steps, by considering the gap between the required final pattern and the monitored pattern as not acceptable, according to tolerances or relative margins which can be set in the memory 84 of weaving machine 2. For example, it can be edited at HMI 82 that transition zones which have shifted of more than 0.3 mm from the expected position in the woven fabric should induce an adjusting step of the path and/or the tension of the warp sheet 34 within weaving machine 2 for rearranging the colour segments distribution. For example such a shift or other potential defaults of the pattern can be imputable to deviations in the drawing-in steps of the pile yarns, deviations in the printing steps, or desynchronization of the weaving machine. Camera 58 can check the position of the whole transition zones along the beating point and monitor their offset.

The operation of rollers 52 and 54 allows varying the tension of the warp sheet 34.

If individual actuators are used as considered in variant here-above, it is also possible to vary the path and the tension of one or several of the warp yarns.

According to another approach, adjustment of the printed pattern might occur by incorporating at least one pile warp yarn into a backing fabric BF2 or BF4 for one or several picks. This allows changing the visible parts of the corresponding yarn or yarns 24.

According to an alternative approach, the adjusting step can be implemented by modifying a vertical distance A between the two pile fabrics during weaving, this distance A being defined between the centers of two weft yarns 36 belonging respectively to backing fabric BF2 and backing fabric BF4. This allows changing the zone of pile warp yarn 24 forming a burl and the length of the tuft legs, thus the point at which they are cut along line L. As shown on FIG. 9, if distance A varies from a first value $\Delta_1$ at pick III to a second value $\Delta_2$ at pick VII, this allows re-arranging the colour segments distribution of pile warp yarn 24 between pile fabrics F2 and F4. In the example of FIG. 9, value $\Delta_2$ is larger than value $\Delta_1$. Value $\Delta_2$ can be smaller than value $\Delta_1$ if segments S241, . . . are shifted in the other direction. This allows bringing these segments back to their nominal positions. Actually, according to a non-represented aspect of the invention, variation of distance A can be progressive between picks III and VII. For instance, the value of distance A can be varied by 0.1 to 0.3 mm between picks III and VII. Distance A is preferably varied in the same way for all warp yarns 24 of warp sheet 34. By varying the tension of the warp sheet with the operation of rollers 52 and 54, the distance A can slightly be varied accordingly.

This modification of the vertical distance between the pile fabrics can also be obtained with lancets having a wedge shape. These lancets are more or less introduced within the shed along axis Y, according to the needs.

Alternatively, the height of the pile legs is set by a cloth table or pile rail. The height of the cloth table or pile rail can be adjusted with a complementary non-represented adjusting unit like adjustable pistons of motorized endless screws connected to the cloth table to modify the vertical distance between the two fabrics in the process of being woven, thus the pile height.

According to another approach, it is also possible to modify printed pattern P24 by varying the operation sequence of printed head 92. In other words, it is possible to adjust the length and the position of the printed segments S241 to S252 in order to take into account the actual pattern obtained on the pile fabrics F2 and F4. For example, if the adjusting sub-assembly unit 50 detects a trend of offset like the transition zones of one or several pile warp yarn migrate backward or forward compared to the transition zones of the other pile yarns, and in the two final fabrics, then the print head 92 can be instructed to print differently. The length and the position of some printed segments or the position of these segments along the pile can be modified. In other words the treatment unit can be instructed by ECU 80, in a closed loop control process, to change the operation sequence and to adapt the printed patterns as a function of the monitored defaults on the final fabrics, so as to print and obtain corrected patterns in the fabrics which correspond to the patterns required by the weaver.

Figure 11:
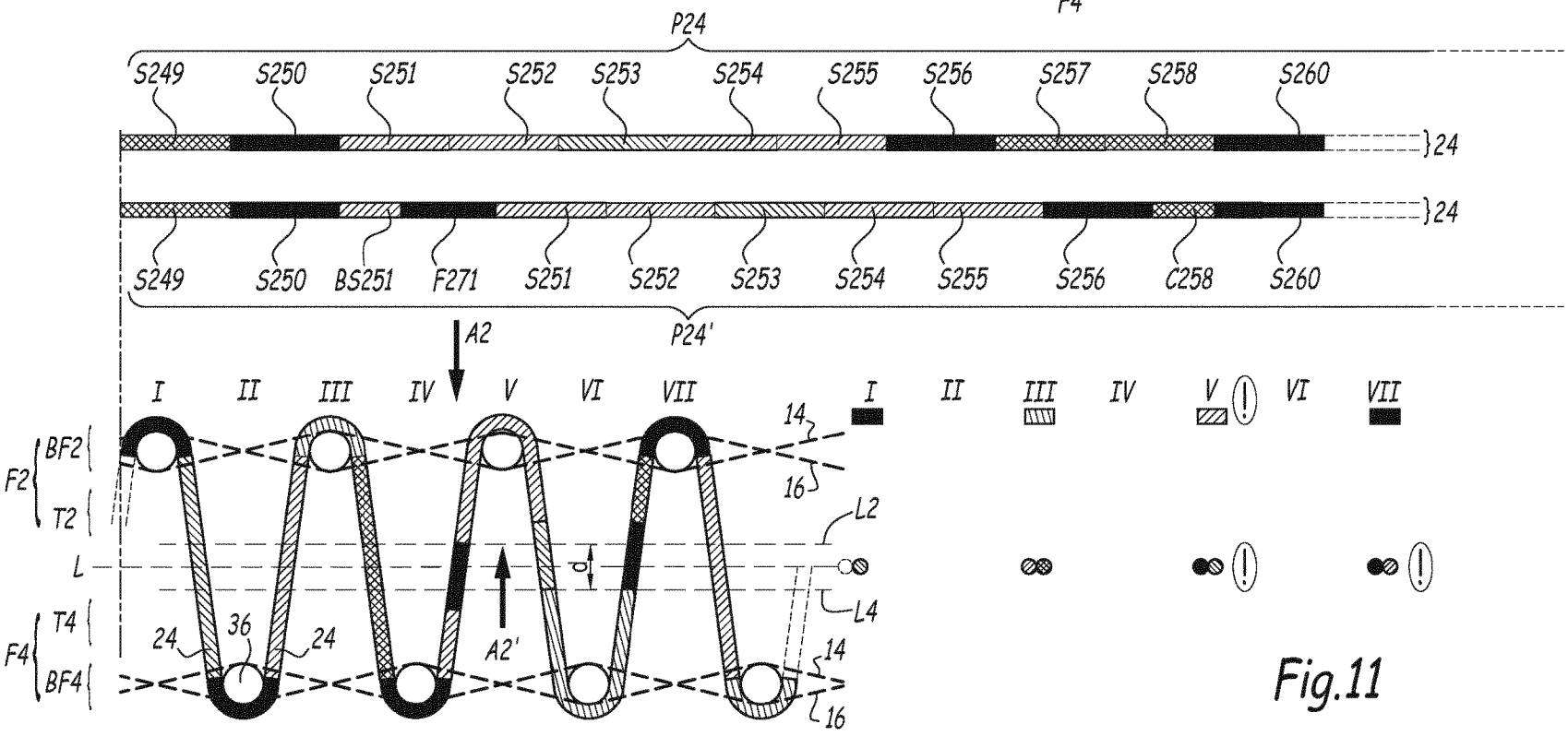
FIG. 11 shows an information similar to FIG. 8 in case a faulty segment is printed on a warp yarn.

The alternative method is represented on FIG. 11 where a faulty section F271 has been printed on warp yarn 24. On this figure, P24 represents a portion of the normal printed pattern formed by segments S249 to S260, which corresponds to the pattern represented on FIG. 8, P24' represents the same portion of the printed pattern in case faulty section F271 has been printed. The path of this portion of printed pattern is visible in the lower part of FIG. 11, between picks IV and VII.

According to this method, the adjusting sub-assembly 50 can monitor the segments of the sheet 34 of warp yarns and particularly the segments of the warp yarn 24. A non-represented camera is arranged on the exit side of the treatment unit 90, for instance just behind the printing unit 92 visible on FIG. 1, over the warp sheet. This camera is configured to take pictures of the printed segments on the full width of the warp sheet 34.

In the normal configuration represented for warp yarn 24 on FIG. 8 and by pattern P24 on FIG. 11, the camera checks that segments S249 to S260 are correctly printed, by taking successive pictures of these segments. The camera sends these pictures to the ECU 80.

The ECU 80 analyzes the color, location and length of each segment, on the basis of the images received from the camera. In particular, for each segment the location of its transition points is compared in sequence to the required transition point locations of the segments in a data set defining the pattern to be realized. The same applies for the color of each segment and its length.

In the default situation represented by pattern P24', after monitoring and taking pictures of segment S250, the camera takes a picture of segment BS251, which corresponds to the beginning of segment S251 In the normal situation, and of faulty segment F271. The camera transmits these pictures to the ECU 80. This applies also for the successive segments S251 to S260

In such a case, ECU 80 detects that:

segment BS251 is shorter than required, as compared to segments S251 and S252 in the normal situation;

segment F271 is after BS251 and not required;

an offset of the next segments S251 to S256 is visible in the sequence, because of the introduction of two incorrect segments between segments S250 and S251, namely segments BS251 and F271.

These incorrect segments and this offset implies local and permanent defaults in the aspect of the woven and final pile pattern as visible on the right side of FIG. 11.

In particular, the ECU 80 compares these segments to the required segments and controls "in real time" the treatment unit 90, while the process of weaving is running, to adjust the process of printing the segments as quickly as possible. In such a situation the ECU 80 drives the offset of the full pattern P24' whose printing will be anticipated on the time scale.

In the same time, the ECU 80 can compute that a mechanical correction cannot be enough to shift the sequence, provided it is a general shift of the pattern on the warp sheet. In such a case, the approach of FIG. 9 is not applicable.

Thus, in such a case, after applying successive segments S251 to S256 on warp yarn 24', that as quickly as possible after the default segment F271 has been detected, the printing sequence is adjusted and the treatment unit 90 is driven to shift its sequence earlier/backward so that:

segment S257 is not printed;

segment S258 is shortened and printed as a C258 segment; to do this, the transition points position of segment S258 are modified;

the next segments of pattern P24' are identical to segment S260 and its following segment in pattern P24, for the pile burl formation at pick VII and during the following picks.

Thanks to this adjustment step of the weaving machine, the warp yarn 24' will be woven within the top and the bottom pile fabrics F2 and F4 around weft yarns 36 as illustrated on FIG. 11, and the faulty situation is limited to a small zone of each fabric, between picks V and VII. The rest of the produced pattern is safe still, and the local default might not be obvious at first sight.

Advantageously, for all the above-mentioned methods, the segments of the warp yarns for the top fabric F2 and for the bottom fabric F4 are simultaneously monitored, and the possible adjusting operations can be controlled simultaneously by ECU 80 which manage the production of the two fabrics from the required pile patterns. According to the type and the scale of detected defaults, the weaving machine drives the adjusting steps at the treatment unit 90, at the buffer mechanism 40, or/and at the shedding unit 6 with a preset priority ranking, and synchronizes its machine components accordingly.

In the examples of FIGS. 4, 8, 9 and 11 transition between two printed segments of a printed pattern is sharp. In other words, it takes place along an imaginary line surrounding the warp yarn 24. Every printed segment of a tuft has the same colour over its whole radial cross section. Particularly, the contours of the tuft segment are in the same colour, since the treatment operations participate in applying uniform dyeing to the warp yarns. The treatment operations made simultaneously on all the warp yarns spread on a warp sheet help to draw accurately the pattern on the full surface of the yarns, and with a good absorption of the dyeing material, such that it is not possible to differentiate any side of the tufts. The radial cross section is defined as cut at right angle to the long axis of the tuft.

Figure 12:
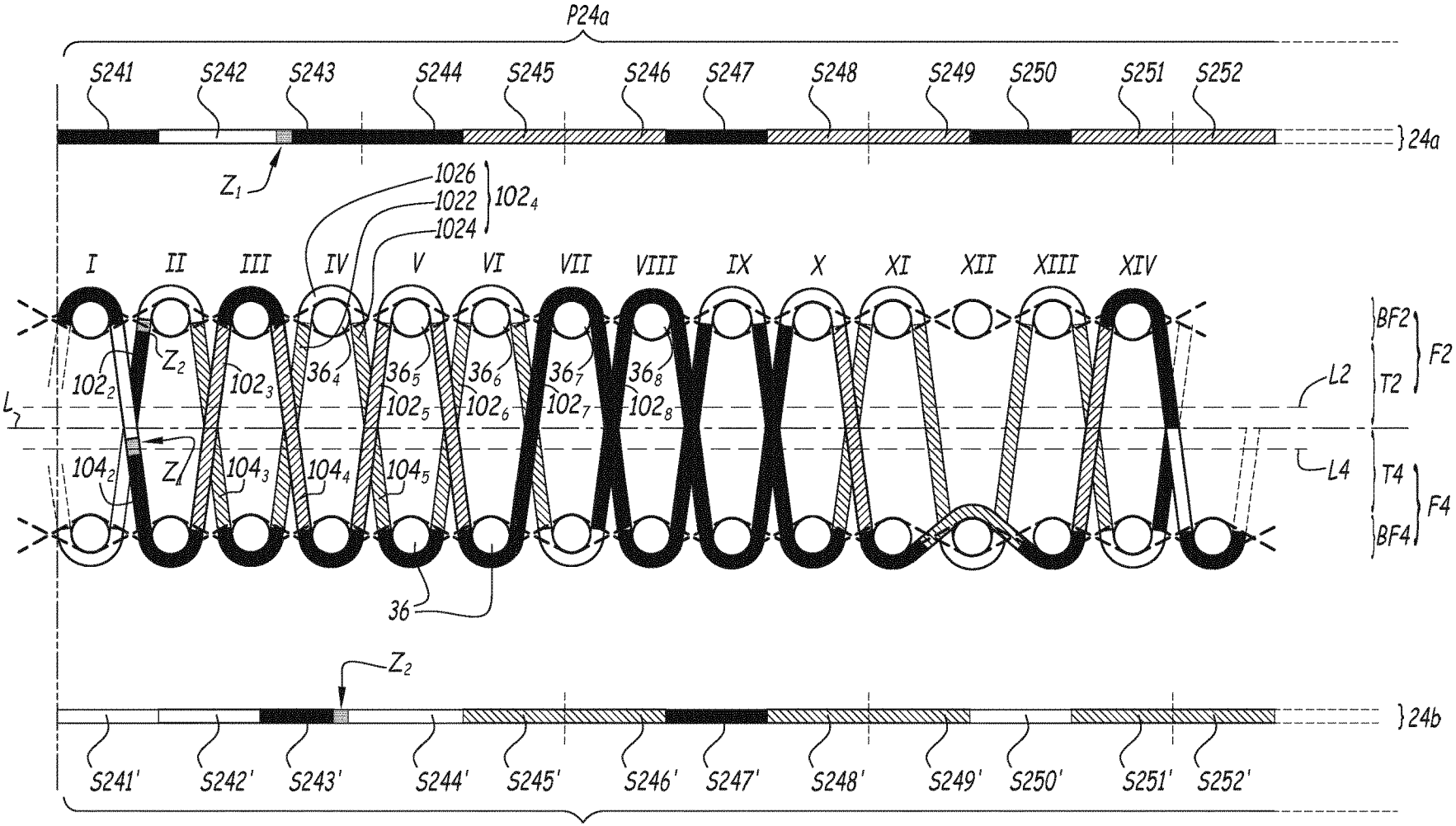
FIG. 12 is a view similar to the left part of FIG. 4 showing fourteen picks for another method and another fabric according to the invention.

FIG. 12 represents fourteen picks I to XIV of a method for manufacturing two pile fabrics F2 and F4 according to the invention. Each pile fabric F2 or F4 includes a backing fabric BF2 or BF4, woven with binding warp yarns 14 and 16 and in-woven weft yarns 36, and tuft portions T2 and T4 extending away from the backing fabric on the front side of each pile fabric.

In a variant, one of the binding warp yarns might be straight and form a reinforcing yarn or filling yarn for the corresponding backing fabric.

One considers the tuft $\mathbf{102}_4$ formed in top pile fabric F2 at pick IV. This tuft includes two legs 1022 and 1024 and one burl 1026 respectively formed by segments S249', S251' and S250' of pile warp yarn 24*b*. The colour of burl 1026 is different from the colour of legs 1022 and 1024. The colour of these two legs is the same. However, these two legs could have different colours, provided that printed pattern P24*b* is adapted. All other tufts $\mathbf{102}_i$, with i a variable integer between I and XIV, include two legs 1022 and 1024 and one burl 1026 joining these two legs. $\mathbf{102}_i$ denotes tufts formed in pile fabric F2 at pick i. Similarly, $\mathbf{104}_i$ denotes tufts formed at pick I in pile fabric F4.

The transition between the colours of burls 1026 and legs 1022 and 1024 is not systematically sharp but may be progressive with a colour gradient, as represented by the transition zones Z1 and Z2 between segments S242 and S243 and between segments S242' and S243' for tufts $\mathbf{102}_2$ and $\mathbf{104}_2$ on FIG. 12.

Alternatively, the transition zone between the pile top of the tufts and the pile burl can be made of some successive intermediate segments of colour.

The transition zones are located at the ends of the burl segments and at the ends of the pile leg segments. The transitions zones between a pile segment and a burl segment are located preferably all at the same height of the fabric, more preferably in the backing fabric BF2 or BF4. Most preferably, the transition zones of a tuft are located symmetrically at the same height of the fabric. Advantageously, monitoring the height of the transition zones in the backing fabric BF2 or BF4 makes the offset of segments easier to adjust, and the process of adjusting easier to manage for the whole fabric.

Pile tufts $\mathbf{102}_4$, $\mathbf{102}_5$ and $\mathbf{102}_6$ turn around weft yarns $\mathbf{36}_4$, $\mathbf{36}_5$ and $\mathbf{36}_6$ of top pile fabric F2 which are consecutive, that is which follow each other in backing fabric F2 along the warp direction.

Pile tufts $\mathbf{102}_7$, $\mathbf{102}_8$ and $\mathbf{102}_9$ have black legs 1022 and 1024 whereas tufts $\mathbf{102}_4$, $\mathbf{102}_5$ and $\mathbf{102}_6$ have grey legs. Tufts $\mathbf{102}_4$, $\mathbf{102}_5$, $\mathbf{102}_6$ and $\mathbf{102}_9$ have white burls, whereas tufts $\mathbf{102}_7$ and $\mathbf{102}_8$ have black burls.

All the tufts $\mathbf{102}_i$ and $\mathbf{104}_i$ represented on FIG. 12 are made from pile warp yarns 24 which belong to the same yarn set, that is which go through the same opening of reed 28. A yarn set is the simplest set of binding and pile warp yarns whose combination is mainly repeated along the weft insertion axis Y of the fabric. In practice, the tufts originating from the same yarn set are located, along axis Y, between the same binding warp yarns 14 and 16. The number of warp yarns belonging to the same yarn set is not limited.

Once cut along an horizontal line L, or more preferably along one of two parallel horizontal lines L2 and L4 as explained here-above in conjunction with FIGS. 8 and 9, top pile fabric F2 present at least two tufts $\mathbf{102}_5$ and $\mathbf{102}_6$ which have two legs of the same colour, namely grey and turn respectively around a first weft yarn $\mathbf{36}_5$ at pick V and a second consecutive weft yarn $\mathbf{36}_6$ at pick VI. This fabric F2 also includes tufts $\mathbf{102}_7$ and $\mathbf{102}_8$ with two black legs each. These two tufts turn respectively around a weft yarn $\mathbf{36}_7$ at pick VII and a consecutive weft yarn $\mathbf{36}_8$ at pick VIII. The weft yarns $\mathbf{36}_7$ and $\mathbf{36}_8$ of picks VII and VIII are consecutive to the weft yarns $\mathbf{36}_5$ and $\mathbf{36}_6$ of picks V and VI.

In such a fabric F2, it is possible to have different colours for a pile pattern visible from the front side of the fabric and for a pile pattern visible from the back side of the fabric, without needing to incorporate dead pile yarns into the backing fabric.

As shown for pile warp yarn 24*b* at picks XI to XIII, it is possible to use a W weave pattern for anchoring pile tufts into the backing fabric, namely backing fabric BF4 in the example. In such a case, pile warp yarn 24*b* goes around three consecutive weft yarns by turning externally around weft yarn $\mathbf{36}_{11}$ at pick XI, then internally around a second consecutive weft yarn $\mathbf{36}_{12}$ at pick XII and externally around a third consecutive weft yarn $\mathbf{36}_{13}$ at pick XIII. The pile burl portion of pick XI in the backing fabric BF4 and the pile burl portion of pick XII of the two consecutive tufts in the warp direction belong to two different warp yarns 24 of the same yarn set. The respective segments of colour of the two pile burls are different. The two segments of colour of the two consecutive pile burls at pick XIII and pick XIV of the backing fabric BF4 are also different from each other. Particularly, the middle of the consecutive segments of the two consecutive pile burls do not disclose the same colour.

Consider, for instance, pile tuft $\mathbf{102}_2$ and $\mathbf{102}_3$ which are consecutive in pile fabric F2. Pile tuft $\mathbf{102}_2$ includes three segments S243', S244' and S245' with different colours. Such is also the case for pile tuft $\mathbf{102}_3$, with segments S246, S247 and S248. Actually, these tufts can be provided with only two segments of different colours.

Moreover, segments S244' and S247, which respectively correspond to the pile burl portions of pile tufts $\mathbf{102}_2$ and $\mathbf{102}_3$, have two different colours.

The same comments apply to other consecutive pile tufts in the two respective pile fabrics F2 and F4, including at the level of the W weave at picks XI-XIII in pile fabric F4.

According to an important aspect of the invention, the colour segments respectively applied on warp yarns 24 vary along the width of the two pile fabrics F2 and F4, that is in a direction parallel to axis Y. Treatment unit 90 is configured for this. For instance, printing head 92 can be mounted on a carriage which is movable parallel to axis Y and the working operation instructions sent by ECU 80 to printing head 92 may vary according to the position of this printing head along axis Y.

Other approaches can be implemented, in particular if printed head extends on the whole width of weaving machine 2. In such a case, printing head has a number of outlet orifices corresponding to the number of pile warp yarns to be dyed and the flow of ink coming out of each of these openings is controlled individually.

According to a non-represented aspect of the invention, it might be relevant to print some warp yarns downstream of treatment unit 90. A movable printing unit can be used for this purpose. In particular, a second printing head can be installed close to shedding unit 6, in order to print or reprint colour segments where appropriate, in particular when a correction is needed.

As shown on FIGS. 13 to 17, where the same elements as the ones shown on FIGS. 4 and 8 have the same references, different binding structures can be used with the invention.

Figure 13:
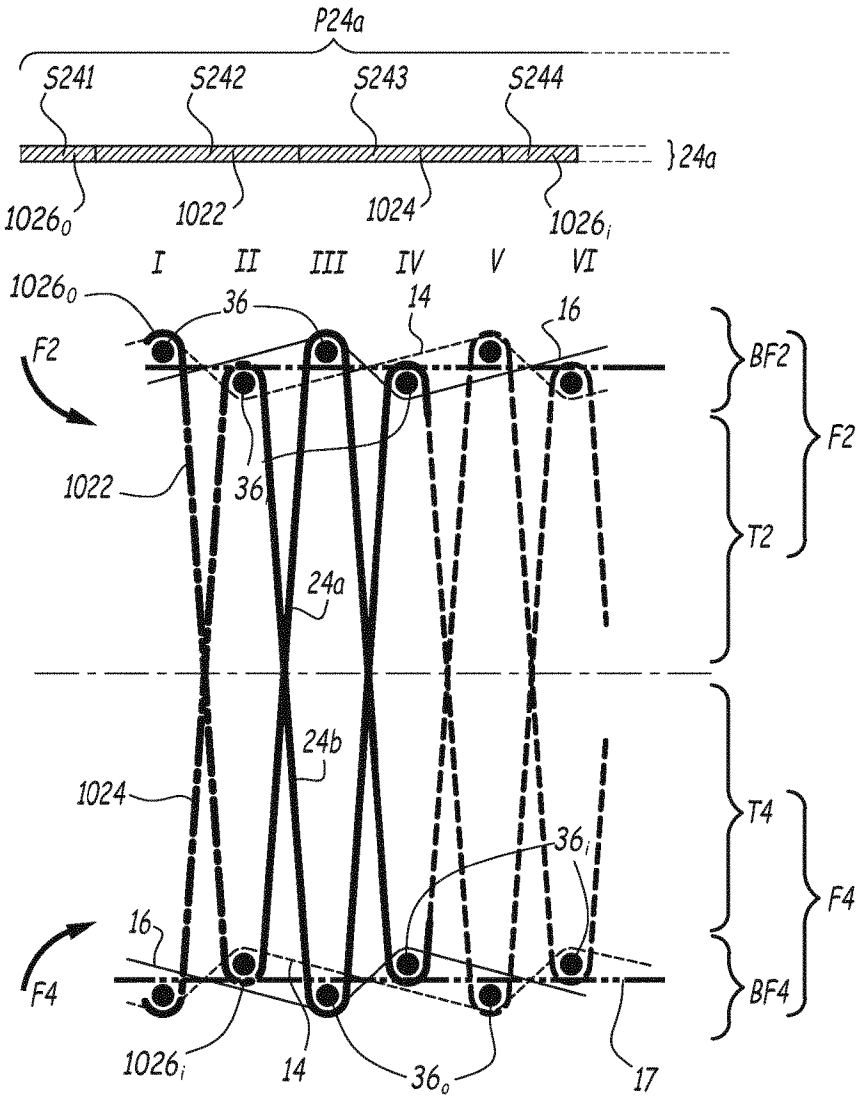

In the example of FIG. 13, binding warp yarns 14 and 16 are used in conjunction with a tension warp yarn 17. The tension warp yarn 17 can be replaced by or associated with a filling warp yarn. The tension warp yarns, the binding warp yarns or/and the filling warp yarns are known as ground warp yarns. Weft yarns 36 are divided between inner weft yarns $\mathbf{36}_i$ and outer weft yarns $\mathbf{36}_o$ respectively located on the inner or front side of each fabric and on the outer or back side of each fabric with respect to tension warp yarns 17. The portion of the pile warp yarns 24*a* and 24*b* which will constitute the pile burls turning around the inner weft yarns $\mathbf{36}_i$ will not be visible on the back side of the fabrics F2 and F4. Thus, if one considers pile warp yarn 24*a* between picks I and II, its printed pattern can be divided into a first segment S241 corresponding to an outer burl portion $\mathbf{1026}_o$, a second segment S242 corresponding to a first pile leg 1022, a third segment corresponding to a second pile leg 1024 and a fourth segment corresponding to an inner burl portion $\mathbf{1026}_i$, as shown in the upper part of FIG. 13. The pile legs 1022 and 1024 and thus the second and third segments, have different lengths in order to accommodate the difference between the location of the weft yarns $\mathbf{36}_i$ and $\mathbf{36}_o$ with respect to tension warp yarn 17. Similarly, segments S241 and S244 might have different lengths, in order to respectively form a long burl $\mathbf{1026}_o$ and a short burl $\mathbf{1026}_i$ whose ends are out of the backing fabric. The transition zones are located at the same height of the fabric out of the fabric.

With such a binding structure, a high density can be obtained warpwise, so that several pile leg segments will have to be coloured similarly in order to produce a pattern point in the final requested printed pattern P2' and equivalent on the front face of the fabrics F2 and F4. In other words, the segments of printed patterns P24*a* and equivalents are repeated on the length of each pile warp yarn to obtain the same pattern than a lower density fabrics.

Furthermore and advantageously, with such binding structures for high density, it becomes possible for the weaver to print patterns more finely, in order to obtain fabrics representing a drawing with high definition.

Figure 14:
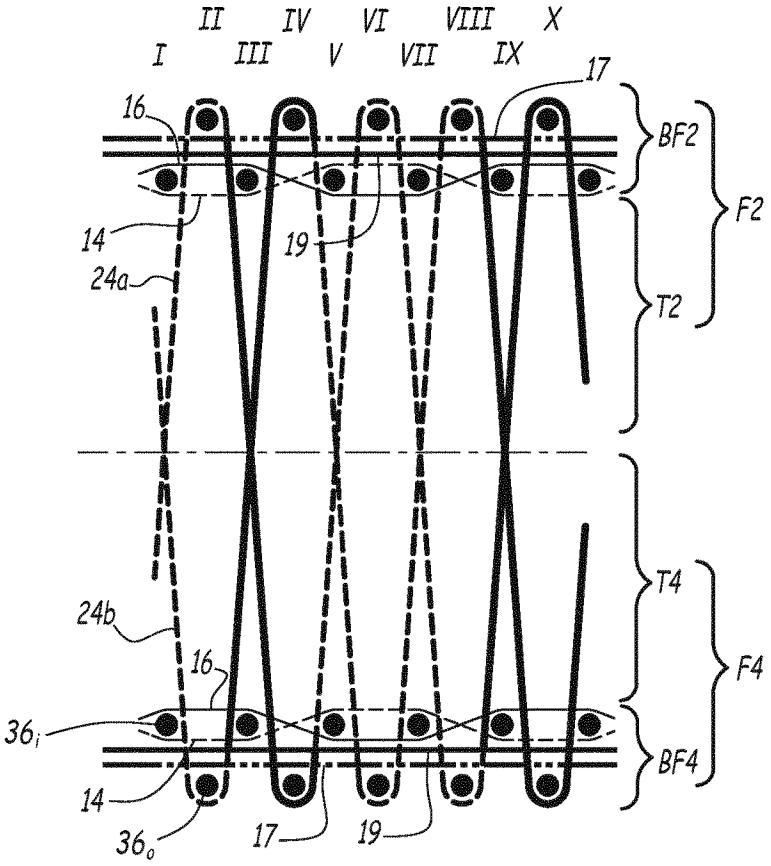
FIGS. 13 to 17 are views similar to the left part of FIG. 4 showing several picks for some other methods and some other fabrics according to the invention.

In the example of FIG. 14 each pile warp yarn forms a tuft every two picks. The length of each pile leg is the same for each pile warp yarn. In other words, the pile legs and pile burls are regularly spaced along the warp direction. In this case, the backing fabric BF2 or BF4 is thick since it includes a tension warp yarn 17 associated with a filling warp yarn 19 and with the binding warp yarns 14 and 16. The backing fabric weft yarns are not inwoven within the binding warp yarns 14, 16 but still belong to the backing fabrics BF2 or BF4 respectively on the backside of fabric F2 and fabric F4. In such a case, the separation zones between the portions of the pile warp yarns 24*a* and 24*b* respectively forming the burls and the legs of the tufts can be roughly printed since these separation zones are not visible on the pile side of the fabrics F2 and F4 because they are buried into the thick backing fabrics. The fixation of the tufts in the backing fabric is improved compared to FIG. 13. Some pile burls of consecutive tufts around backing fabric weft yarns disclose different segments of colour, so that they form a back pattern on their backside.

Figure 15:
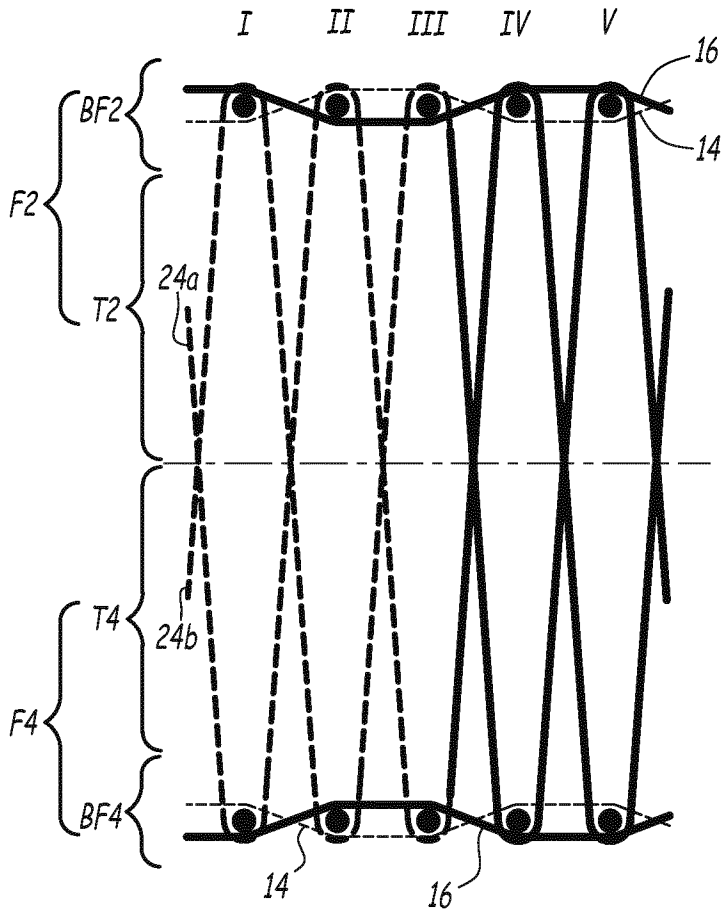

In the example of FIG. 15 no tension warp yarn is used. The pile burls of consecutive tufts around backing fabric weft yarns disclose different segments of colour, even if the pattern might not be as visible as the back pattern of the examples of FIGS. 4 and 8 to 13. The portions of the pile warp yarns 24*a* and 24*b* respectively forming the consecutive pile burls are small, such that the corresponding segments of colour are small and the transition zones are very close to each other. On such a thin backing fabric, it is relatively difficult to control the position of the burl segments on the back sides of the respectively fabrics F2 and F4.

The structures represented on FIGS. 13-15 have the benefit of a high productivity of the weaving process, because of the low amount of weft yarns needed for a given amount of tufts.

Figure 16:
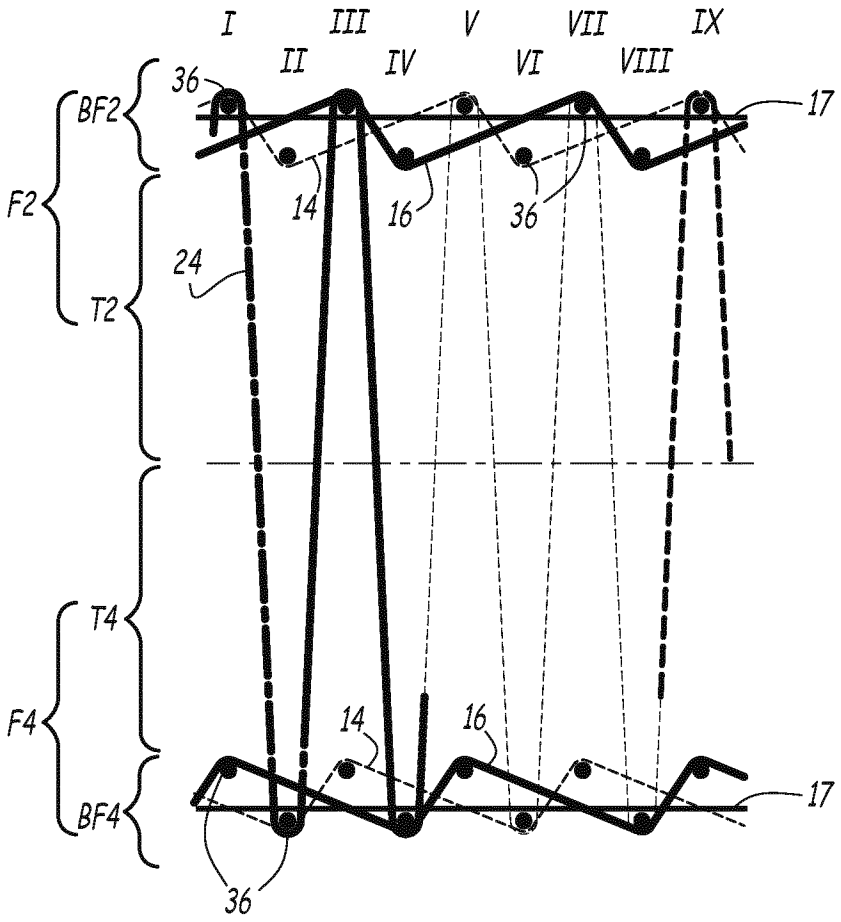

In the example of FIG. 16, the tufts are formed in the two fabrics F2 and F4 by a single pile warp yarn 24 turning around a weft yarn 36 every two pick. A tension warp yarn 17 is used in each backing fabric. With such an approach, the density of piles in the warp direction is less than in the previous examples, but the tuft fixation is improved compared to FIG. 12. The design is less spread on the warp sheet during printing of the printed pattern and the pattern point should be computed considering a shorter length of warp material.

Figure 17:
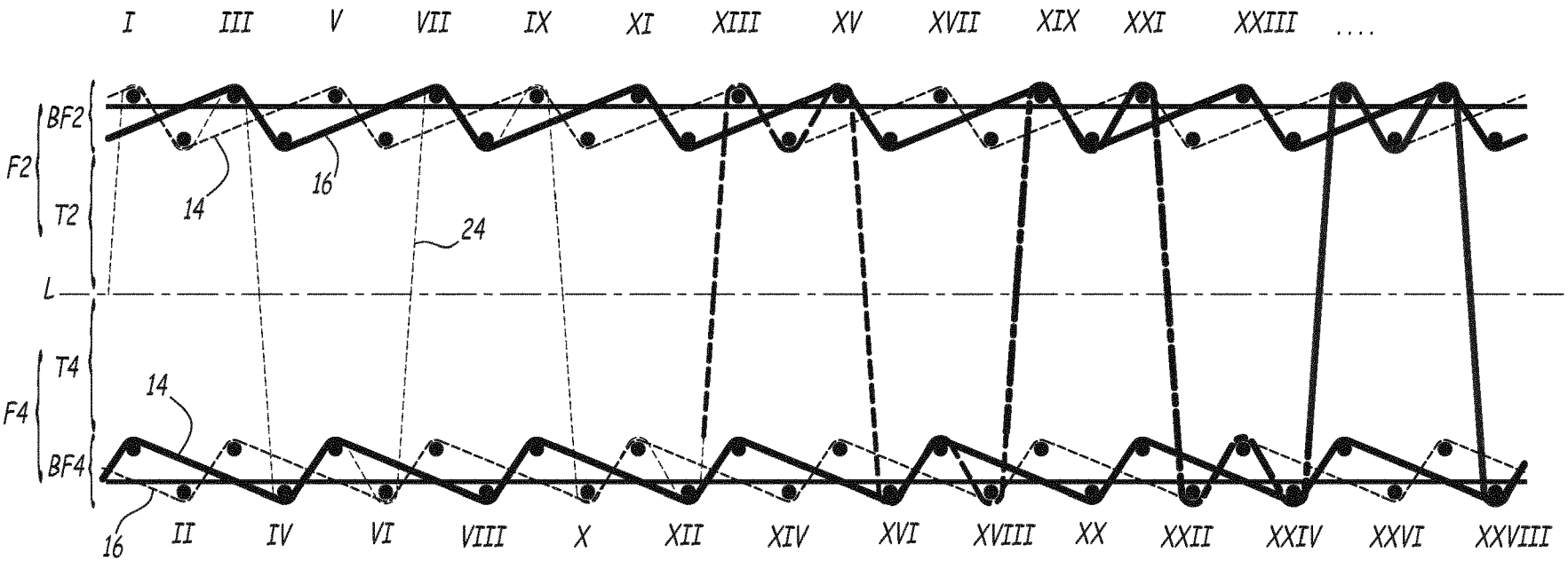

In the example of FIG. 17, pile warp yarn 24 follows a W weave in each backing fabric BF2 and BF4 like patterning pile yarns 24 are interlaced in the backing fabrics BF2 and BF4 around three weft yarns consecutive in the warp direction, by turning externally around a first weft yarn, internally a second weft yarn and externally a third weft yarn. The pattern obtained on the back side of each pile fabric F2 and F4 is globally the same as the one formed by the pile legs because of the W weave, with picks XII and XVIII, where a colour change occurs and creates a very small longitudinal offset of the pattern between the back side and the front side of the fabric F4. Alternatively, the pile warp yarns can be interlaced in the backing fabric between more than three consecutive weft yarns to improve the tuft fixation.

According to a non-represented aspect of the invention, different kinds of binding structures can be used in the same pile fabric.

On FIGS. 13 to 17, the different colours of the pile warp yarns 24*a*, 24*b* are represented by different types of lines (plain, chain-dotted, axis line) with different thicknesses.

Coming back now to the computation of the printed patterns P24*a*, P24*b*, P24 or equivalent on the basis of the required final patterns P2, P2', P4 or equivalent, which applies to all embodiments, it is to be noted that an algorithm is implemented which is based on an analysis of each required final pattern. In this analysis, each point of the final pattern is identified by its coordinate X; along the longitudinal axis X, with i between 1 and N, N being the number of points in the pattern in the length direction of the fabric, and its coordinate $Y_J$, with J between 1 and G, G being the number of points in the direction of the width of the fabric. Each point is associated with the corresponding colour to be obtained in the final pattern, so that a data set can be considered where each point is defined by ($X_i$, $Y_J$, colour).

Alternatively, the required final patterns can be extracted from a program of a traditional carpet system whose instructions are related to the motion of pre-dyed warp yarns in the patterning shedding machine. These instructions can be computed and transformed by the ECU 80 in data for the weaving machine 2.

In other words, a numeric discretization of the final pattern is implemented.

The definition of the discretization of the final pattern can be high since a colour can be assigned to each pile leg. Thus, for a fabric with several millions of legs per $m^2$, the invention allows weaving an image with several millions of pattern points per $m^2$.

Once the final pile pattern has been discretized, as explained here-above, a computation takes place for each pile warp yarn $\mathbf{24}_j$, with j between 1 and N', j being the number of pile warp yarns along the Y axis, in order to transform the local positions of each point ($X_i$, $Y_J$, colour) of the final pattern along axis X in the finished fabrics into a local position for a corresponding segment along the corresponding pile warp yarn 24; of the corresponding yarn set. For FIGS. 13-15, the pile warp yarns 24*a* or the pile warp yarn 24*b* of the same yarn set creates the pattern point ($X_i$, $Y_J$, colour) as a function of its longitudinal position in the final pattern, along axis X. Moreover, a colour mix corresponding to the colour mentioned here-above is determined on the basis of the CMYK combination based on the cyan, magenta, yellow and white or black colours. This enables computing for each pile warp yarn 24; a printed pile pattern P24; exemplified here-above with patterns P24, P24*a* and P24*b*.

Alternatively, treatment products of some premixed-colours can be used, like premixed green and brown inks for producing fabrics made of green and brown patterns.

Each printed pattern 24; includes, for each segment S241, S242, . . . , S241', S242', . . . , its starting point and its end point, together with the corresponding colour to be printed on the corresponding warp yarn $\mathbf{24}_j$.

The algorithm can also set an origin starting point to which will define the origin of all printed patterns $\mathbf{24}_j$.

In other words, each segment of colour printed on one pile warp yarn 24; is defined by the following data: (j, $L_{j1}$, $L_{j2}$, CMYK) where:

j is the order number of the pile warp yarn $\mathbf{24}_j$ in the width of the fabric, between 1 and N', $L_{ij1}$, is the start point of the $i^{th}$ segment corresponding to the point having coordinate $X_i$, with i between 1 and N, along the length of pile warp yarn 24$_i$, $L_{ij2}$ is the end point of the same segment, CMYK is the colour defined from the basic colours to be applied on this segment.

In practice, when all segments are consecutive one after the other, with no unprinted space, one has the following relationship $L_{ij2}=L_{i+1|1}$.

Actually the conversion algorithm which converts the discretized final pattern ($X_i$, $Y_J$, colour) into the respective printed patterns (j, $L_{ij1}$, $L_{ij2}$, CMYK) will take into account at least some of the following parameters, the desired pile height, the desired pile raw density, the number of pile yarns per yarn set the weave structure (for instance V or W interlacing), the yarn tension, the yarn titre/count or TPI (threads per inch), the yarn material, the weather conditions, the speed of the warp sheet 34.

As explained here-above in conjunction with FIGS. 13 to 17, the weaver may choose the binding structure as a function of the requested appearance, comfort, smoothness or effects, as desired by the end customer. This binding structure is used for determining, for a given length Lx of the fabric, the necessary length of material required for each pile warp yarn. This also allows precisely locating each printed segment in the printed pattern that is precisely determining $L_{ij1}$, and $L_{ij2}$ for each segment.

The algorithm also takes into account the shearing process which occurs after separation of the two fabrics F2 and F4 out of the weaving machine 20 during the offline process. This shearing process must give a uniform pile leg height and may take place along two parallel lines, as mentioned here-above with respect to FIGS. 8 to 10. So, a portion of the printed segments will not remain in the final two fabrics, as visible on FIG. 10.

Once the pattern P24 to be printed on each pile warp yarn 24; has been determined by the algorithm, this data is used by electronic control unit 80 in order to generate a spread sheet which is stored in memory 84 and which includes data in the form (j, $t_i$, $l_i$, CMYK) where:

j is the same integral number as mentioned here-above, $t_i$ is the time at which application of the colour should start, after $t_0$, $l_j$ is the length of the segments, in millimetre, and CMYK is the colour to be applied.

For instance, for warp yarn number 893, if a black segment is to be applied 20 seconds after start, on five millimeters, the corresponding data set will be: (893, 20, 5, black).

When colours are applied along each yarn 24 at preset spaced position according to the corresponding printed pattern P24$_i$, they will penetrate in the fiber of the corresponding warp yarn 24$_j$ and will dye it.

The successive transition line between the respective segments S241, S242 . . . S241', S242' . . . of the respective warp yarns 24 are set considering the length of each segment to dye before weaving.

Since, as mentioned here-above, the drawing in unit formed by yarn feeder 26 provides a uniform tension of the pile warp yarns 24 along the width of the warp sheet 34, printer 92 prints colour segments on pile warp yarn segments having the same tension, which favours parallel running of the pile yarns between yarn feeder 26 and shedding unit 6 and simultaneous arrival of all segments of the printed patterns P24; devoted to one pick.

Progression of the respective pile warp yarns 24 and binding warp yarns 14 and 16 toward shedding unit 6 is not continuous, but may take place by successive strokes, due to the shed opening and to the movement of the reed 28. Under such circumstances, printing can occur in successive steps during a stop or down time of the pile warp yarns 24 in their progression towards shedding unit 6.

According to an aspect of the invention which is represented on FIG. 4 only, some graduation marks M24 and M24' may form parts of the printed pattern P24*a*, P24*b*, P24 or P24$_j$ in order to materialize the limit between two consecutive segments printed to form a figuring pile leg segment 1022 or 1024 or a figuring burl 1026. In this example, these two marks are respectively located between segments S246 and S247, S249' and S250'. Alternatively, such marks can be located between two segments separated by the sharing line L or applied regularly in the printed pattern, e.g. every five millimetres. These graduation marks can be made of thin black rings which are different from the segments of colour, or whose form and/or colour can differentiate from the figuring pile and burl segments. Either they disappear after treatment or they remain in the final pile fabrics F2 and F4, provided that they are small enough not to be visible for the common user. These graduation marks can be useful for assessing whether or not the printed pattern on a given pile warp yarn or a group of piles is being shifted from its normal position, since such graduation mark can be easily identified by cameras 56 and 58.

Such graduation marks are, in particular, useful when one yarn is printed in one colour on a long distance corresponding to a large number of segments, e.g. in red. The black rings allow detecting the actual position of the corresponding printed pattern. These graduations marks are also useful while producing carpets whose front side and back side patterns are the same. It makes possible for the adjusting unit to monitor better the lengths of segments of the pile warp yarns.

Thus, locating the graduation marks M24 and M24' along a given pile warp yarn 24 allows efficiently using the adjusting sub-assembly 50 of weaving machine 2. Provided the transition marks of consecutive tufts have similar locations, they are at the same height in the fabric.

Alternatively, the graduation marks can be any other colour than black, or be unprinted rings on the pile yarns which can be monitored and identified by the adjusting sub-assembly 50.

Alternatively the graduation marks can be produced with an invisible ink like fluorescent ink whose spectrum is not perceived by human, but can be detected and monitored by a UV camera belonging to the adjusting sub-assembly 50.

The HMI 82 reports information to the weaver with respect to the on-going weaving process and allows the weaver to change optionally some parameters of the weaving process as needed, for instance the pile height or the shearing margin distance d. This interface 82 also allows monitoring of the printer 92 and of the weaving loom 4. It can also provide information regarding the printing process of the pile warp yarns, in particular:

a warning to the weaver in case a default is detected by cameras 56 and 58;

storing information on the localization of such defaults in the shed or in the fabrics;

some figures, in particular statistics, about the detected defaults.

This data displayed or edited on interface 82 can also be taken into account by electronic control unit 80 in order to optimize the printing operations, while taking into account the requested pattern. It makes possible for the weaver to adjust manually the process through the HMI interface 82, for example with a correction factor related to the application or to the article.

The invention is represented on the figures in case the pile warp yarns 24 alternate between the top and bottom fabrics F2 and F4 and a step is provided for separating these two fabrics by cutting the pile warp yarns with a non-represented cutting unit in order to create double legged tufts $\mathbf{102}_i$, $\mathbf{104}_i$. However, according to a non-represented embodiment of the invention, some or the totality of the fabrics can be provided with pile warp yarns which form loops around some weft yarns inserted in the shed outside a backing fabric. This enables having a bouclé effect or a fabric with ribs. For such fabrics, one can consider loop segments along the loops visible on the front side of the fabric, with the consecutive burl segments visible on the back side of the fabric. A first pattern is visible on the front side of the fabric, and a second pattern is visible on the back side. Thanks to the invention, this second pattern can potentially be different from the first pattern. It should be understood that the loop segments of bouclé carpet do not form double legged tufts, but they are quite similar to pile segments of cut pile carpets for creating a printed design and for the invention. One can consider that the pile loop portions on the front side of a bouclé carpet are comparable to parallel tufts in the width of the carpet, each tuft being made of a burl and two pile leg portions, these two legs being respectively joined with a previous tuft leg and a next tuft leg belonging to respective previous and next tufts of the same warp yarn. These legs form external loops on the front side of the fabric by surrounding the weft yarn externally of the backing fabric; they are not cut, besides the pile burls on the backside of the backing fabric weft yarns.

Due to the great versatility of the method of the invention according to which each pile warp yarn can be dyed with a corresponding colour, it is possible to weave a pile yarn fabric with tufts $\mathbf{102}_i$, $\mathbf{104}_i$ displaying more than 16 different colours with a pile density preferably over 300 000 piles per $m^2$ more preferably over 500 000 piles per $m^2$, most preferably over 1 000 000 piles per $m^2$. Actually, the number of displayed colours can be more than 32, preferably more than 64.

Thanks to the invention, the design required for a pile fabric on its front side and/or on its back side can be sharp, without mixed contours, while being obtained with a simple and repetitive binding structure, whose arrangement is more predictable than traditional patterned carpets. Thanks to the invention the local treatment of segments on the pile warp yarns offer unlimited possibilities to produce countless patterns of carpets on its two sides.

Moreover, the invention allows changing the pattern and the binding structure of pile fabrics F2 and F4 produced on weaving machine 2, without losing a substantial amount of material and without spending a lot of time to settle the weaving machine, since the main operation is to use the algorithm to compute the respective printed patterns P24*a*, P24*b*, P24, P24$_j$ . . . mentioned here-above from the final pattern P2, P2', P4, . . . , required for the respective pile fabrics F2, F4, without modifying the pile warp yarns feeding unit formed by creel 20.

Advantageously, pile warp yarns 24, and possibly binding warp yarns 14 and 16 are uncoloured and white. This is easier to manage for the weaver and facilitates maintenance of the weaving machine 2. Moreover, the bobbins 22 can be set head to tail, in order to avoid a stop of the loom work. Preferably the ends of the bobbins are connected by splicing and use so-called "spliced yarns".

The fact that the creel 20 is simpler than in known weaving machines improves its reliability and lowers the number of pile breakages due to less frictions between pile yarns and less angular means for guiding the yarns. Moreover, the simpler structure of the creel provides a more balanced weaving sequence and less tension in the warp sheet.

According to another aspect of the invention, it is possible to couple the above-identified method with a traditional process including pre-coloured pile warp yarns. Then, some pile warp yarns will be used as delivered by some bobbins and the other pile warp yarns will be printed on demand as explained here-above.

Pile warp yarns can be made of Polyamid or Polyester material.

Moreover, some of the warp yarns, like ground warp yarns and some pile warp yarns on the side of the carpet can be woven without being printed.

According to another aspect of the invention, long pile fabrics or shaggy carpets can be obtained with the invention. The invention offers the possibility for such fabrics to disclose long piles or long loops with different colours.

Alternatively, a random mode can be selected for printer 92, which induces a randomly applied printed pattern on the pile warp yarns 24. According to another approach, large areas of randomly applied colours can be generated on the pile fabrics F2 and F4. They will look like "patches" on the final product.

Alternatively, the transitions zones between a pile segment and a burl segment are located on the backside of the fabric, or on the pile side of the fabric.

According to a non-represented alternative embodiment of the invention, the colour printed in some of the segments can be variable along the length of these segments which are due to form pile legs, like pile legs 1022 and 1024 identified here-above. In such a case, these segments are dyed while taking into account several superposed patterns. One obtains a carpet with different patterns defined in the depth of the pile layer. After successive shearing operations, the carpet design can be changed due to the different patterns disclosed by the top of the piles.

The invention is not limited to the case where the different products applied on the warp yarns are inks. The local treatment applied by the treatment unit 90 may consist in applying other types of products, such a chemical agents including acid or chlorine. The local treatment performed by unit 90 may, instead of applying a product, consist in submitting the warp yarns to heating/burning, an UV light, microwaves or an electric current.

Alternatively, a supplementary and dedicated treatment unit could apply segments on the binding yarns or/and on the weft yarns.

Several of the treatments mentioned here-above can be combined.

Each pile fabric F2 or F4 presents one or several pile patterns P2, P2', P4, . . . .

According to another aspect of the invention, a complementary treatment may occur during a finishing operation, after weaving, in order to improve or reveal some pattern segments.

The invention is represented on the figures in case weaving machine 2 makes use of a single warp sheet 34 for all the pile yarns. Alternatively, several warp sheets can be used by superposing or setting aside several groups of pile yarns for independent treatment between the feeding units and the shedding unit. This can be operated by several treatment units.

The embodiments and/or variants considered here-above can be combined in order to generate new embodiments of the invention, is the framework of the attached set of claims.

The invention claimed is:

1. A weaving machine for simultaneously weaving a top pile fabric and a bottom pile fabric, each pile fabric presenting one or several pile patterns and including tufts made from pile warp yarns, binding warp yarns and weft yarns, the machine comprising a pile warp yarns feeding unit, a binding warp yarns feeding unit, a shedding unit for creating a shed with the pile warp yarns and the binding warp yarns, said pile warp yarns for the top pile fabric and for the bottom pile fabric forming a warp sheet made by juxtaposition of the pile warp yarns between the pile warp yarns feeding unit and the shedding unit, wherein the warp sheet consists of the pile warp yarns, a weft insertion unit for inserting the weft yarns in the shed, in successive insertion cycles, a beating-up mechanism for beating the weft yarns into the shed, a take up system for taking-up the two pile fabrics, a control unit for controlling operation of the weaving machine, a treatment unit located along a path of the warp sheet between the pile warp yarns feeding unit and the shedding unit for printing segments of differently colored inks on at least some of the pile warp yarns for the top pile fabric and segments of different colored inks on at least some of the pile warp yarns for the bottom pile fabric, and an adjusting sub-assembly, different from the treatment unit and interposed on the path of the warp sheet, for simultaneously adjusting, in the warp sheet, a position of the segments of differently colored inks in the top pile fabric and the segments of different colored inks in the bottom pile fabric, wherein the adjusting sub-assembly includes at least one sensor for determining, in the warp sheet and along the pile warp yarns, the position and/or the length of the segments of differently colored inks on the pile warp yarns for the top pile fabric and the position and/or length of the segments of different colored inks on the pile warp yarns for the bottom pile fabric.

2. The weaving machine according to claim 1, wherein the treatment unit is configured for varying the segments of differently colored inks along a direction parallel to a weft insertion axis.

3. The weaving machine according to claim 1, wherein the treatment unit includes at least one printing head for applying a color treatment in the form of the segments of differently colored inks on the pile warp yarns.

4. The weaving machine according to claim 1, comprising a drawing-in unit for drawing the pile warp yarns from the pile warp yarn unit, wherein the drawing in unit provides a uniform tension and/or a uniform yarn feed rate of the pile warp yarns along a direction parallel to a weft insertion axis.

5. The weaving machine according to claim 1, wherein it further comprises a buffer mechanism located, along a path of the pile warp yarns, between the treatment unit and the shedding unit, for providing a constant warp yarns speed at the level of the treatment unit, while compensating the pile warp yarns speed fluctuations due to shedding and beating-up.

6. The weaving machine according to claim 1, wherein the at least one sensor is for identifying a trend of an offset of the segments in the top pile fabric and a trend of an offset of the segments in the bottom pile fabric.

7. The weaving machine according to claim 6 wherein the adjusting sub-assembly is configured for varying the position and/or the length of some segments of differently colored inks on at least one pile warp yarn of the for the top pile fabric and for varying the position and/or the length of some segments of different colored inks on at least one pile warp yarn for the bottom pile fabric by changing the operation sequence of the treatment unit.

8. The weaving machine according to claim 1, wherein the adjusting sub-assembly includes a set of rollers adapted to modify the tension and/or the feed rate of the warp sheet between the pile warp yarns feeding unit and the shedding unit or individual actuators adapted to modify the tension and/or the feed rate of individual pile warp yarn between the pile yarns feeding unit and the shedding unit.

9. The weaving machine according to claim 1, wherein the adjusting sub-assembly is configured for adjusting the position of some segments of differently colored inks in the top pile fabric and for adjusting the position of some segments of differently colored inks in the bottom pile fabric by shifting a printed pattern along a warp axis.

10. The weaving machine according to claim 9, wherein the adjusting sub-assembly is configured for adjusting the position of said some segments of treatment in the top pile fabric and the bottom pile fabric by moving the pile warp yarns with respect to the treatment unit.

11. The weaving machine according to claim 1, wherein the machine comprises a cutting unit for cutting warp yarns into cut pile tufts to separate the top pile fabric and the bottom pile fabric.

12. A method for simultaneously weaving a top pile fabric and a bottom pile fabric, each fabric presenting pile printed patterns and including tufts made from pile warp yarns, binding warp yarns and weft yarns, this method taking place on a face-to-face weaving machine which comprises:

a pile warp yarns feeding unit, a binding warp yarns feeding unit, a shedding unit for creating a shed with the pile warp yarns and the binding warp yarns, said pile warp yarns for the top pile fabric and for the bottom pile fabric forming a warp sheet made by juxtaposition of the pile warp yarns between the pile warp yarns feeding unit and the shedding unit, wherein the warp sheet consists of the pile warp yarns, a weft insertion unit for inserting the weft yarns in the shed in successive insertion cycles, a beating-up mechanism for beating-up the weft yarns into the shed, a take-up system for taking-up the two pile fabrics, a drawing-in unit for drawing the pile warp yarns from the pile warp yarn feeding unit and a control unit for controlling the weaving machine wherein the method includes at least the following steps:

a) presenting the pile warp yarns to a treatment unit located, along a path of the warp sheet, between the pile warp yarns feeding unit and the shedding unit, b) applying, with the treatment unit, different segments of differently colored inks on at least some of the pile warp yarns of the top pile fabric and different segments of differently colored inks on at least some of the pile warp yarns of the bottom pile fabric, c) weaving the treated pile warp yarns into the top pile fabric and the bottom pile fabric, and d) simultaneously adjusting, in the warp sheet, a position of the segments of differently colored inks in the top pile fabric and the bottom pile fabric, this adjusting step further comprising at least:

d1) taking a picture of the warp sheet and transferring the picture to the control unit which uses the picture to compute the position and/or length of the segments of differently colored inks along the pile warp yarns for the top pile fabric and to compute the position and/or length of the segments of differently colored inks along the pile warp yarns for the bottom pile fabric.

13. The method according to claim 12, wherein step b) includes a printing operation during which a printed yarn pattern is applied on the pile warp yarns to provide a pile printed pattern for the top pile fabric and a pile printed pattern for the bottom pile fabric, in the form of successive dyed segments forming the different segments of differently colored inks, for forming a final pile pattern on each pile fabric.

14. The method according to claim 13, wherein the method includes a preliminary step, implemented before step a) and consisting in aa) determining the printed yarn pattern from the final pile pattern of each pile fabric.

15. The method according to claim 14 wherein, the printed pattern defined during the preliminary step aa) includes first dyed segments dedicated to the pile printed pattern in the top pile fabric and second dyed segments dedicated to the pile printed pattern in the bottom pile fabric.

16. The method according to claim 15, wherein, the printed pattern defined during the preliminary step aa) includes third dyed segments dedicated to a back side pattern of the top pile fabric and fourth dyed segments dedicated to a back side pattern in the bottom pile fabric.

17. The method according to claim 12, wherein the adjusting step d) comprises one or more of the following elementary steps, implemented after step d1) as the result of the step d1):

d2) varying the tension and/or yarn feed rate of at least one pile warp yarn, d3) incorporating at least one pile warp yarn into a backing fabric as a dead pile yarn, for one or several picks, d4) modifying a vertical distance between the two pile fabrics or d5) varying the operation sequence of the treatment unit on at least one pile warp yarn, as a function of the actual position of a previously applied segment on the same pile warp yarn.

18. The method according to claim 12, wherein, during step c), the pile warp yarns alternate between the top and bottom pile fabrics and wherein the method includes a subsequent step consisting in:

e) separating the top and bottom pile fabrics by cutting the pile warp yarns in order to create double legged tufts.

19. The method according to claim 12, wherein, during step c), the pile warp yarns form loops around some internal weft yarns inserted in the shed outside each backing fabric of each pile fabric, on the front side of each pile fabric.

20. The method according to claim 12, wherein the segments applied at step b) vary along a direction parallel to a weft insertion axis.

* * * * *